US005740583A

United States Patent [19]

Shimada et al.

[11] Patent Number: 5,740,583

[45] Date of Patent: Apr. 21, 1998

[54] ELECTRIC VACUUM CLEANER

[75] Inventors: Sadahiro Shimada; Akihiro Hirano, both of Yokaichi; Yuichi Shimizu, Omihachiman; Hidenori Kitamura, Shiga-ken; Kazuma Suoh, Kusatsu; Masakazu Onda, Yokaichi, all of Japan

[73] Assignee: Matsushita Electric Industrial Co., Ltd., Osaka, Japan

[21] Appl. No.: 636,791

[22] Filed: Apr. 22, 1996

[30] Foreign Application Priority Data

| | | | |
|---|---|---|---|
| Apr. 21, 1995 | [JP] | Japan | 7-096383 |
| May 9, 1995 | [JP] | Japan | 7-110435 |

[51] Int. Cl.[6] ..... A47L 9/04

[52] U.S. Cl. ..... 15/377; 15/414

[58] Field of Search ..... 15/339, 377, 410, 15/414; 174/47, 69; 191/12.2 R, 12.4

[56] References Cited

U.S. PATENT DOCUMENTS

| | | | |
|---|---|---|---|
| 3,614,705 | 10/1971 | Descarries | 15/377 |
| 3,965,526 | 6/1976 | Doubleday | 15/377 |
| 4,079,965 | 3/1978 | Moughty et al. | 174/47 |
| 4,204,297 | 5/1980 | Yasunaga et al. | 15/377 |
| 4,652,063 | 3/1987 | Genoa et al. | 174/47 |
| 4,697,299 | 10/1987 | Brinkoff et al. | 15/339 |
| 4,989,295 | 2/1991 | Gühne et al. . | |

FOREIGN PATENT DOCUMENTS

| | | | |
|---|---|---|---|
| 0123428 | 10/1989 | European Pat. Off. . | |
| 0537457 | 4/1993 | European Pat. Off. . | |
| 0664988 | 8/1995 | European Pat. Off. . | |
| 4404394 | 8/1995 | Germany . | |
| 61-164649 | 10/1986 | Japan . | |
| 2-180233 | 7/1990 | Japan . | |
| 4-189337 | 7/1992 | Japan . | |
| 40 6-30872 | 2/1994 | Japan | 15/377 |

*Primary Examiner*—Terrence Till

*Attorney, Agent, or Firm*—Pollock, Vande Sande & Priddy

[57] ABSTRACT

An electric vacuum cleaner includes a main body. A hose is connected to the main body. A motor-drive brush is provided in a floor nozzle. An extension pipe connects the floor nozzle and one end of the hose. An electric conductor is located in the extension pipe. The extension pipe includes an outer tube, an inner tube, a first electric connection terminal, a second electric connection terminal, a first conductor casing, and a second conductor casing. The first electric connection terminal is pfovided on one end of the outer tube. The second electric connection terminal is provided on one end of the inner tube. The inner tube slidably extends into the outer tube. The electric conductor is connected between the first electric connection terminal and the second electric connection terminal. The electric conductor is accommodated in the first conductor casing and the second conductor casing. The first conductor casing is provided on the outer tube. The second conductor casing is provided on the inner tube. The outer tube has a dust suction passage. The inner tube has a dust suction passage. The first conductor casing has an interior isolated from the dust suction passage in the outer tube. The second conductor casing has an interior isolated from the dust suction passage in the inner tube.

12 Claims, 24 Drawing Sheets

ELECTRIC VACUUM CLEANER

BACKGROUND OF THE INVENTION

1. Field of the Invention

This invention relates to an electric vacuum cleaner having a contractible extension pipe defining a part of a dust suction passage.

2. Description of the Prior Art

Japanese published unexamined utility model application 61-164649 discloses an electric vacuum cleaner having a contractible extension pipe defining a part of a dust suction passage. The extension pipe in Japanese application 61 has an outer tube and an inner tube which movably extends into the outer tube in a telescopic manner. An electrical extension cord extends along the extension pipe. Opposite ends of the extension cord have plugs connected to a floor nozzle device and a manual switch section respectively. The extension cord has a curled portion so that the extension cord can follow expansion and contraction of the extension pipe. In Japanese application 61, a major part of the extension cord is exposed regardless of whether the extension pipe is fully expanded or fully contracted. Thus, a protector for the extension cord is substantially absent.

SUMMARY OF THE INVENTION

It is an object of this invention to provide an improved electric vacuum cleaner.

A first aspect of this invention provides an electric vacuum cleaner comprising a main body; a hose connected to the main body; a floor nozzle; a motor-drive brush provided in the floor nozzle; an extension pipe connecting the floor nozzle and one end of the hose; and an electric conductor located in the extension pipe; wherein the extension pipe comprises an outer tube, an inner tube, a first electric connection terminal, a second electric connection terminal, a first conductor casing, and a second conductor casing, the first electric connection terminal being provided on one end of the outer tube, the second electric connection terminal being provided on one end of the inner tube, the inner tube slidably extending into the outer tube, the electric conductor being connected between the first electric connection terminal and the second electric connection terminal, the electric conductor being accommodated in the first conductor casing and the second conductor casing, the first conductor casing being provided on the outer tube, the second conductor casing being provided on the inner tube, the outer tube having a dust suction passage, the inner tube having a dust suction passage, the first conductor casing having an interior isolated from the dust suction passage in the outer tube, the second conductor casing having an interior isolated from the dust suction passage in the inner tube.

A second aspect of this invention is based on the first aspect thereof, and provides an electric vacuum cleaner wherein the first conductor casing is fixed to or integral with the outer tube and the second conductor casing is fixed to or integral with the inner tube, and the second conductor casing slidably extends into the first conductor casing.

A third aspect of this invention is based on the first aspect thereof, and provides an electric vacuum cleaner wherein the electric conductor folds at least one position in an axial direction.

A fourth aspect of this invention is based on the first aspect thereof, and provides an electric vacuum cleaner wherein at least part of the electric conductor comprises a flexible flat cable.

A fifth aspect of this invention is based on the first aspect thereof, and provides an electric vacuum cleaner wherein a part of the electric conductor comprises an expandible and contractible member.

A sixth aspect of this invention is based on the first aspect thereof, and provides an electric vacuum cleaner wherein the electric conductor comprises a rail-shaped conductor, a contact being in touch with the rail-shaped conductor and being slidable relative to the rail-shaped conductor, and another conductor connected to the contact.

A seventh aspect of this invention is based on the first aspect thereof, and provides an electric vacuum cleaner further comprising means for allowing adjustment of a relative position between the inner tube and the outer tube, wherein the allowing means comprises a plurality of engagement portions provided in an outer surface of the inner tube and spaced in an axial direction, an engagement member provided on the outer tube and being engageable with any one of the engagement portions, and an operation member for controlling the engagement member.

An eighth aspect of this invention is based on the seventh aspect thereof, and provides an electric vacuum cleaner wherein the engagement portions and the engagement member are located at a side of the extension pipe opposite the first conductor casing and the second conductor casing.

A ninth aspect of this invention is based on the first aspect thereof, and provides an electric vacuum cleaner further comprising means for allowing adjustment of a relative position between the inner tube and the outer tube, wherein the allowing means comprises a plurality of engagement portions provided in an outer surface of the second conductor casing and spaced in an axial direction, an engagement member provided on the outer tube and being engageable with any one of the engagement portions, and an operation member for controlling the engagement member.

A tenth aspect of this invention provides an electric vacuum cleaner comprising a main body; a hose connected to the main body; a floor nozzle; a motor-drive brush provided in the floor nozzle; and an extension pipe connecting the floor nozzle and one end of the hose; wherein the extension pipe comprises an outer tube, an inner tube, a first electric connection terminal, a second electric connection terminal, an electric conductor, and a conductor casing. The first electric connection terminal is provided on one end of the outer tube, the second electric connection terminal being provided on one end of the inner tube, the inner tube slidably extending into the outer tube, the electric conductor being connected between the first electric connection terminal and the second electric connection terminal, the electric conductor being partially accommodated in the conductor casing, the conductor casing being integrally and axially provided on the inner tube.

An eleventh aspect of this invention is based on the tenth aspect thereof, and provides an electric vacuum cleaner further comprising a sub tube slidably extending into the conductor casing and provided on the outer tube, the sub tube accommodating a part of the electric conductor.

A twelfth aspect of this invention is based on the tenth aspect thereof, and provides an electric vacuum cleaner wherein at least part of the electric conductor comprises a flexible flat cable.

A thirteenth aspect of this invention is based on the tenth aspect thereof, and provides an electric vacuum cleaner wherein a part of the electric conductor comprises an expandible and contractible member.

A fourteenth aspect of this invention is based on the tenth aspect thereof, and provides an electric vacuum cleaner further comprising means for allowing adjustment of a relative position between the inner tube and the outer tube, wherein the allowing means comprises a plurality of engagement portions provided in an outer surface of the inner tube and spaced in an axial direction, an engagement member provided on the outer tube and being engageable with any one of the engagement portions, and an operation member for controlling the engagement member.

A fifteenth aspect of this invention is based on the tenth aspect thereof, and provides an electric vacuum cleaner wherein the engagement portions and the engagement member are located at a side of the extension pipe opposite the conductor casing.

A sixteenth aspect of this invention provides an electric vacuum cleaner comprising a main body; a hose connected to the main body; a floor nozzle; a motor-drive brush provided in the floor nozzle; and an extension pipe connecting the floor nozzle and one end of the hose; wherein the extension pipe comprises an outer tube, an inner tube, a first electric connection terminal, a second electric connection terminal, a rail-shaped electric conductor, a second electric conductor, a contact, and a conductor casing, the first electric connection terminal being provided on one end of the outer tube, the second electric connection terminal being provided on one end of the inner tube, the inner tube slidably extending into the outer tube, the rail-shaped electric conductor having an end connected to the second electric connection terminal, the rail-shaped electric conductor being accommodated in the conductor casing, the conductor casing being integrally provided on the inner tube, the contact being in touch with the rail-shaped electric conductor and being slidable relative to the rail-shaped electric conductor, the second electric conductor having first and second ends connected to the first electric connection terminal and the contact respectively, the second electric conductor being disposed in the outer tube.

A seventeenth aspect of this invention is based on the sixteenth aspect thereof, and provides an electric vacuum cleaner further comprising means for allowing adjustment of a relative position between the inner tube and the outer tube, wherein the allowing means comprises a plurality of engagement portions provided in an outer surface of the inner tube and spaced in an axial direction, an engagement member provided on the outer tube and being engageable with any one of the engagement portions, and an operation member for controlling the engagement member.

An eighteenth aspect of this invention is based on the seventeenth aspect thereof, and provides an electric vacuum cleaner wherein the engagement portions and the engagement member are located at a side of the extension pipe opposite the conductor casing.

A nineteenth aspect of this invention is based on the sixteenth aspect thereof, and provides an electric vacuum cleaner further comprising means for allowing adjustment of a relative position between the inner tube and the outer tube, wherein the allowing means comprises a plurality of engagement portions provided in an outer surface of the conductor casing and spaced in an axial direction, an engagement member provided on the outer tube and being engageable with any one of the engagement portions, and an operation member for controlling the engagement member.

DESCRIPTION OF THE PREFERRED EMBODIMENTS

First Embodiment

Figure 1:
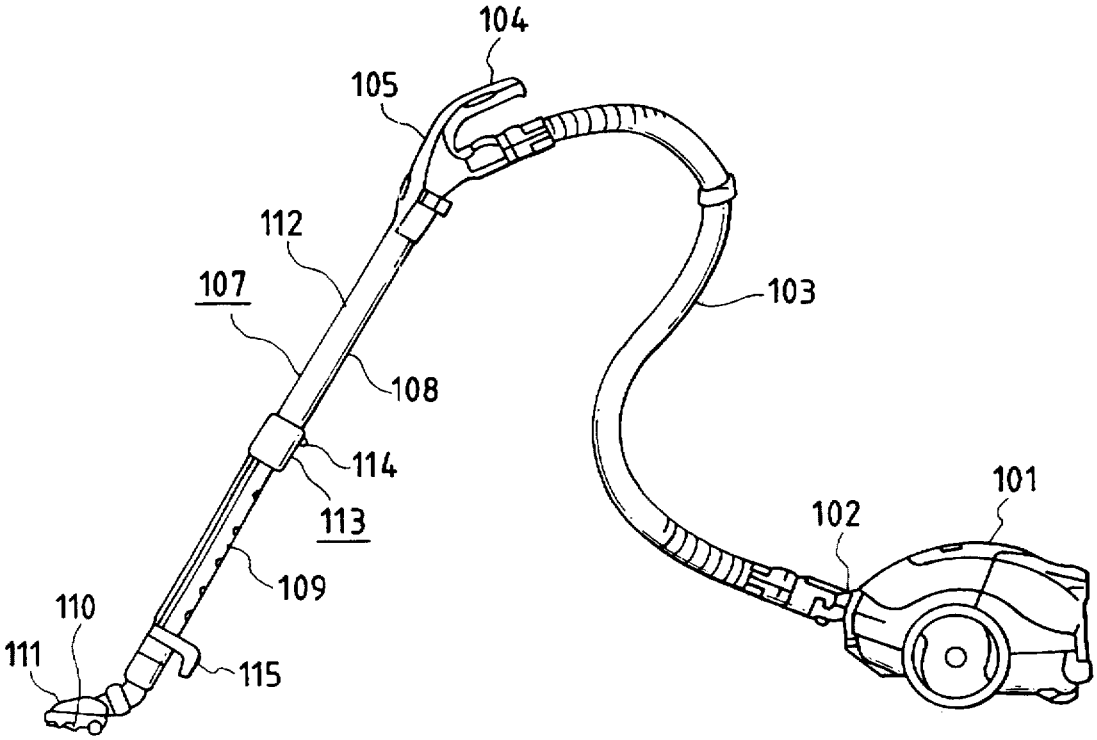
FIG. 1 is a perspective view of an electric vacuum cleaner according to a first embodiment of this invention.

With reference to FIG. 1, an electric vacuum cleaner has a main body 101 containing a motor-driven blower (not shown). The cleaner main body 101 is provided with a suction inlet 102 to which one end of a hose 103 is connected. The other end of the hose 103 is connected to a handle portion 104 having an operation section 105. Operation of the motor-driven blower within the cleaner main body 101 is controlled by manipulating the operation section 105. Electric wires (not shown) extending in the hose 103 provide electric connection between the cleaner main body 101 and the handle portion 104.

One end of an expandible and contractible extension pipe 107 is connected to the handle portion 104. The other end of the extension pipe 107 is connected to a floor nozzle device 111 containing a motor-driven brush 110.

Figure 2:
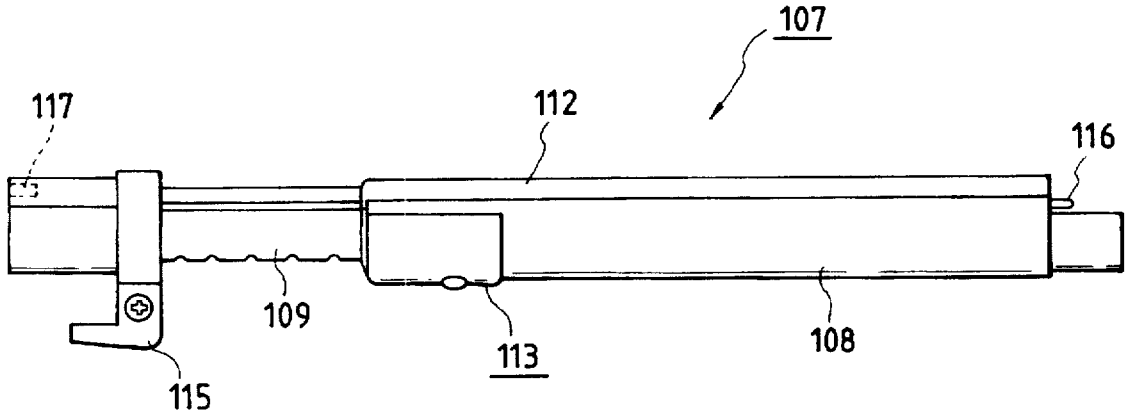
FIG. 2 is a side view of an extension pipe in FIG. 1.

As shown in FIGS. 1 and 2, the extension pipe 107 has an outer tube 108 and an inner tube 109 which movably extends into the outer tube 108 in a telescopic manner. The inner tube 109 can axially move into and from the outer tube 108. An end of the outer tube 108 is connected to the handle portion 104. An end of the inner tube 109 is connected to the floor nozzle device 111. Electric conductors 112 axially extending in the extension tube 107 enable the feed of electric power from the handle portion 104 to the motor-driven brush 110 in the floor nozzle device 111.

The extension pipe 107 is equipped with an adjustment mechanism 113 for adjusting the position of the inner tube 109 relative to the outer tube 108. The adjustment mechanism 113 has an operation member 114. The adjustment mechanism 113 is operated by manipulating the operation member 114.

A hook 115 fixed to the extension pipe 107 or the inner tube 109 can move into and out of a hook reception hole in the cleaner main body 101. In general, the member 115 is used to hook the extension pipe 107 to the cleaner main body 101 after operation of the electric vacuum cleaner is finished. Hooking the extension pipe 107 to the cleaner main body 101 results in a compact configuration of the electric vacuum cleaner.

Figure 3:
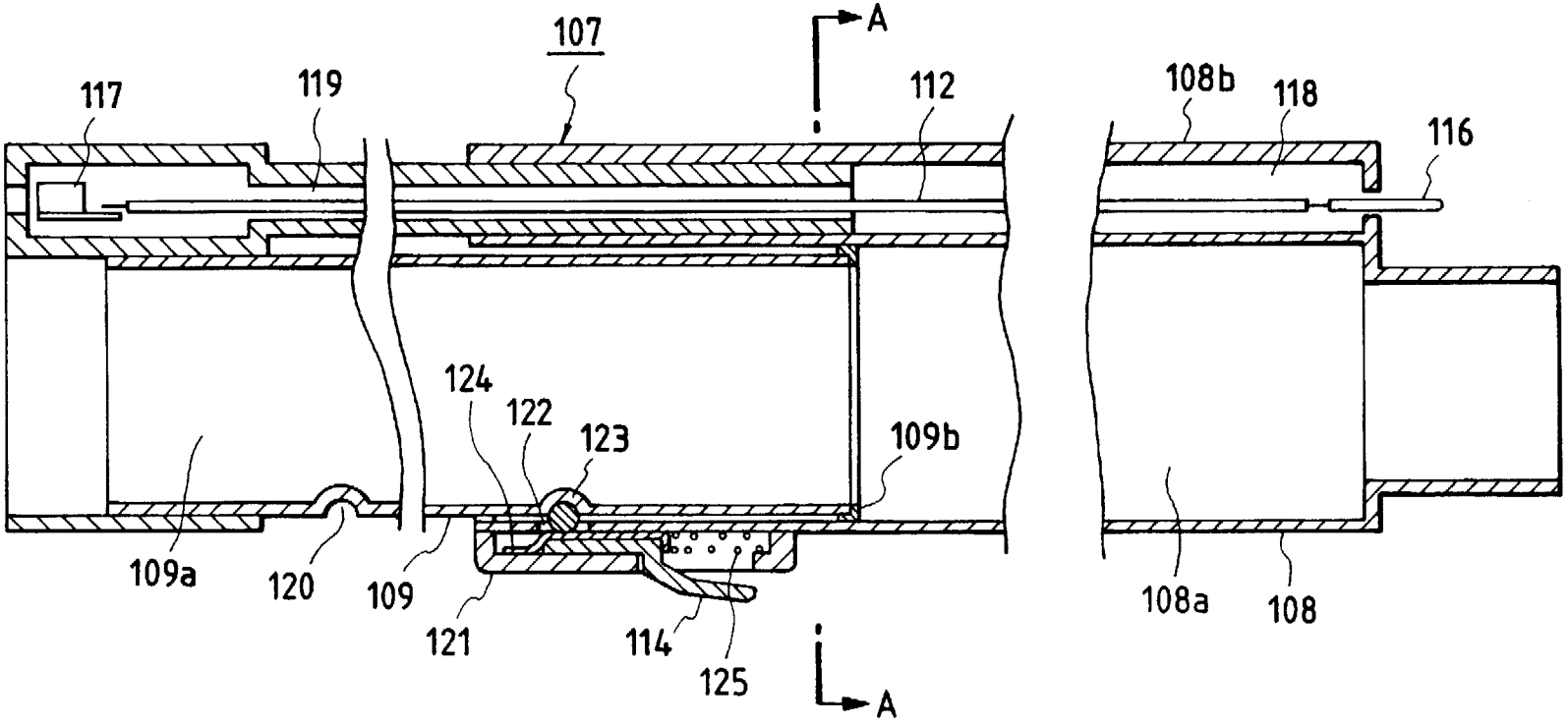
FIG. 3 is a sectional view of the extension pipe in FIG. 2.
Figure 4:
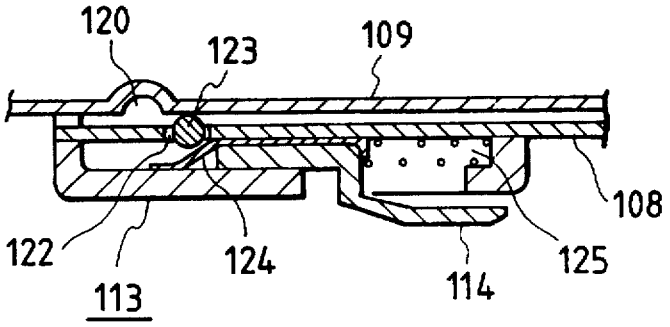
FIG. 4 is a sectional view of a part of the extension pipe in FIG. 3.
Figure 5:
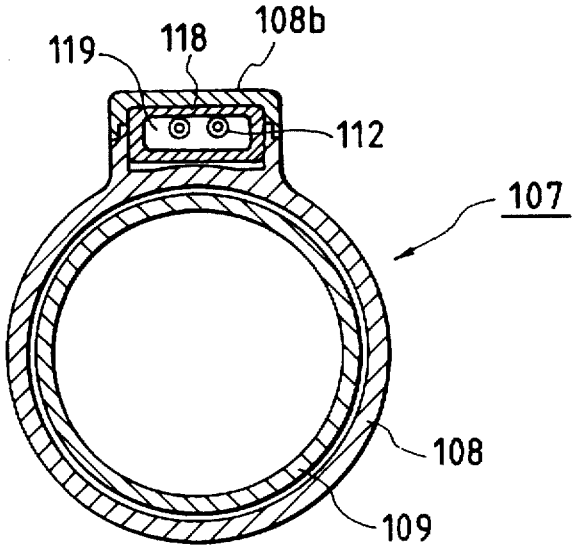
FIG. 5 is a sectional view of the extension pipe taken along the line A—A in FIG. 3.

With reference to FIGS. 3, 4, and 5, the extension pipe 107 will be further described. The end of the outer tube 108 near the handle portion 104 is provided with terminals 116 for electric connection with the handle portion 104. The end of the inner tube 109 near the floor nozzle device 111 is provided with terminals 117 for electric connection with the motor-driven brush 110 in the floor nozzle device 111. The electric conductors 112 extend between the terminals 116 and the terminals 117.

The outer tube 108 has an axially-extending main portion and an axially-extending conductor casing 118. The main portion of the outer tube 108 has cylindrical walls which define a dust suction passage **108*a* therein. The conductor casing 118 has cover walls 108*b* connected to the walls of the main portion of the outer tube 108 and being of a U-shaped cross section. The cover wails 108*b* and an area of the wails of the main portion of the outer tube 108 define an axially-extending inner space in which related portions of the electric conductors 112 are disposed. Accordingly, the conductor casing 118 accommodates the related portions of the electric conductors 112**.

The inner tube 109 has an axially-extending main portion and an axially-extending conductor casing 119. The main portion of the inner tube 109 has cylindrical walls which define a dust suction passage **109*a* therein. The conductor casing 119 includes an axially-extending tube fixed to the end of the walls of the main portion of the inner tube 109 near the floor nozzle device 111. The tube of the conductor casing 119 accommodates related portions of the electric conductors 112. The tube of the conductor casing 119 can axially and slidably move into and from the conductor casing 118 in the outer tube 108** in a telescopic manner.

The interior of the conductor casing 118 in the outer tube 108, in which the related portions of the electric conductors 112 are disposed, is separated and isolated from the dust suction passage **108*a* in the outer tube 108. The interior of the conductor casing 119 in the inner tube 109, in which the related portions of the electric conductors 112 are disposed, is separated and isolated from the dust suction passage 109*a* in the inner tube 109. An annular gasket 109*b* extending at the end of the inner tube 109 is provided between the cylindrical walls of the main portion of the inner tube 109 and the cylindrical walls of the main portion of the outer tube 108 to make an airtight connection therebetween. The gasket 109*b* can slide relative to the cylindrical walls of the main portion of the outer tube 108**.

The electric conductors 112 may also be used as signal transmission lines between the handle portion 104 and the floor nozzle device 111.

The adjustment mechanism 113 and the operation member 114 will now be described in detail. The adjustment mechanism 113 includes a plurality of engagement recesses (engagement portions) 120 provided in the walls of the main portion of the inner tube 109 at equal intervals along the axial direction. The engagement recesses 120 extend in a side of the inner tube 109 opposite the conductor casing 119. The engagement recesses 120 include grooves of a semicircular cross section which extend perpendicular to the axial direction of the inner tube 109. The adjustment mechanism 113 also includes a guide frame 121 fixed to an outer surface of the end of the outer tube 108 near the inner tube 109. The guide frame 121 extends in a side of the outer tube 108 opposite the conductor casing 118. The guide frame 121 accommodates or contains an engagement member 123, a part of the operation member 114, a pressing plate 124, and a resilient member 125. The engagement member 123 extends through an opening 122 in the walls of the main portion of the outer tube 108. The engagement member 123 is movably held by the walls of the main portion of the outer tube 108. Specifically, the engagement member 123 can move in a radial direction (or a direction perpendicular to the axial direction). The operation member 114 is slidably supported on the guide frame 121. Specifically, the operation member 114 can move in the axial direction of the outer tube 108. The pressing plate 124 is fixed to one side of the operation member 114. Accordingly, the pressing plate 124 can move together with the operation member 114. The resilient member 125 urges the operation member 114 and the pressing plate 124 toward the floor nozzle device 111. The resilient member 125 includes, for example, a spring. The pressing plate 124 can contact the engagement member 123. The pressing plate 124 can push the engagement member 123 inward.

The engagement member 123 includes a cylindrical bar, a part of which conforms to each of the engagement recesses 120. Accordingly, the part of the engagement member 123 can be snugly received by each of the engagement recesses 120. It is preferable that the engagement member 123 is made of metal. Alternatively, the engagement member 123 may be made of other material such as hard resin.

Operation of the extension pipe 107, the adjustment mechanism 113, and the operation member 114 will be described hereinafter. FIG. 3 shows that the extension pipe 107 is in a fully expanded state. In the case where the operation member 114 and the pressing plate 124 are in their left-hand limit positions and the extension pipe 107 is in the fully expanded state as shown in FIG. 3, the engagement member 123 extends into end one of the engagement recesses 120 while being held in engagement with the engagement recess 120 by an inwardly urging force applied from the pressing plate 124. Since the pressing plate 124 prevents the engagement member 123 from moving out of the engagement recess 120, the connection between the engagement member 123 and the engagement recess 120 inhibits relative movement between the outer tube 108 and the inner tube 109.

With reference to FIG. 4, as the operation member 114 is slid rightward against the urging force of the resilient member 125, the pressing plate 124 is also moved rightward together with the operation member 114. Thus, the engagement member 123 is released from the pressing plate 124. Under these conditions, contraction and expansion of the extension pipe 107 are allowable. Upon the start of forced movement of the inner tube 109 into the outer tube 108 to contract the extension pipe 107, the engagement member 123 moves out of the engagement recess 120. When the extension pipe 107 is contracted to near a desired length, the application of the force to the operation member 114 by user's finger or fingers is removed so that the pressing plate 124 is moved leftward by the urging force of the resilient member 125. Accordingly, the pressing plate 124 falls into hard contact with the engagement member 123, thereby applying an effective inward force to the engagement member 123. When the engagement member 123 reaches one of the engagement recesses 120, the engagement member 123 falls into engagement with the engagement recess 120 due to the inwardly urging force applied from the pressing plate 124. This connection between the engagement member 123 and the engagement recess 120 inhibits further relative movement between the outer tube 108 and the inner tube 109, that is, further contraction of the extension pipe 107. Upon the start of forced movement of the inner tube 109 from the outer tube 108 to expand the extension pipe 107, the engagement member 123 moves out of the engagement recess 120. When the extension pipe 107 is expanded to near a desired length, the application of the force to the operation member 114 is removed so that the pressing plate 124 is shifted leftward by the urging force of the resilient member 125. Accordingly, the pressing plate 124 falls into hard contact with the engagement member 123, thereby applying an effective inward force to the engagement member 123. When the engagement member 123 reaches one of the engagement recesses 120, the engagement member 123 falls into engagement with the engagement recess 120 due to the inwardly urging force applied from the pressing plate 124. This connection between the engagement member 123 and the engagement recess 120 inhibits further relative movement between the outer tube 108 and the inner tube 109, that is, further expansion of the extension pipe 107.

As the inner tube 109 is moved relative to the outer tube 108, the conductor casing 119 in the inner tube 109 slides relative to the conductor casing 118 in the outer tube 108.

Figure 6:
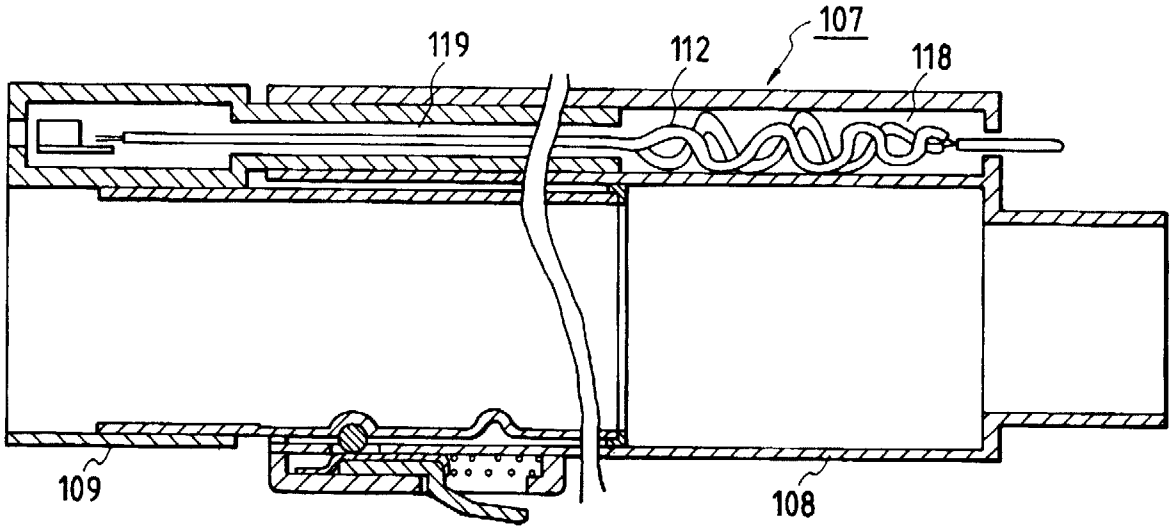
FIG. 6 is a sectional view of the extension pipe in FIG. 2.

FIG. 6 shows that the extension pipe 107 is set in a fully contracted state by maneuvering the operation member 114. In FIG. 6, the engagement member 123 extends into end one of the engagement recesses 120 while being held in engagement with the engagement recess 120 by the inwardly urging force applied from the pressing plate 124. Since the pressing plate 124 prevents the engagement member 123 from moving out of the engagement recess 120, the connection between the engagement member 123 and the engagement recess 120 inhibits relative movement between the outer tube 108 and the inner tube 109. It is preferable that the electric conductors 112 use general-purpose flexible electric wires. When the extension pipe 107 is in the fully contracted state, the electric conductors 112 fold in the interior of the conductor casing 118 in the outer tube 108 as shown in FIG. 6.

The general-purpose flexible electric wires used as the electric conductors 112 are inexpensive. The electric conductors 112 are enclosed and protected by the conductor casings 118 and 119.

As previously described, the interior of the conductor casing 118 in the outer tube 108 is separated and isolated from the dust suction passage **108*a* in the outer tube 108. Also, the interior of the conductor casing 119 in the inner tube 109 is separated and isolated from the dust suction passage 109*a* in the inner tube 109. Accordingly, the interior of the conductor casing 118 and the interior of the conductor casing 119 may not be airtight with respect to atmosphere. This enables easy assembly of the conductor casings 118 and 119. The conductor casings 118 and 119 containing the electric conductors 112 extend outside the dust suction passages 108*a* and 109*a*. Therefore, an air flow in the dust suction passages 108*a* and 109*a* is not disturbed by the conductor casings 118 and 119 containing the electric conductors 112**.

As previously described, the engagement recesses 120 extend in the side of the inner tube 109 opposite the conductor casing 119. The guide frame 121 extends in the side of the outer tube 108 opposite the conductor casing 118. Accordingly, the formation of the engagement recesses 120 can be done without adversely affecting the conductor casing 119. In addition, the assembly of the engagement device supported by the guide frame 121 can be done without adversely affecting the conductor casing 118. Thus, it is possible to easily assemble the extension pipe 107.

The engagement recesses 120 may be hemispherical. In this case, the engagement member 123 is spherical.

It is preferable that the inner tube 109 is made of light metal such as aluminum. In this case, the inner tube 109 can be strong, light in weight, and small in wall thickness. The inner tube 109 may be made of a molded resin. In this case, it is easy to form the inner tube 109 with ribs used as guides for the assembly of parts such as the electric conductors 112, and the terminals 117.

Figure 8:
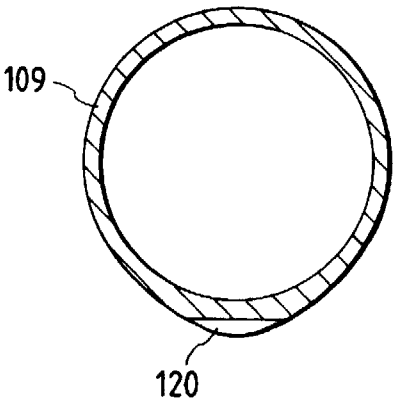
FIG. 8 is a sectional view of the inner tube taken along the line B—B in FIG. 7.
Figure 7:
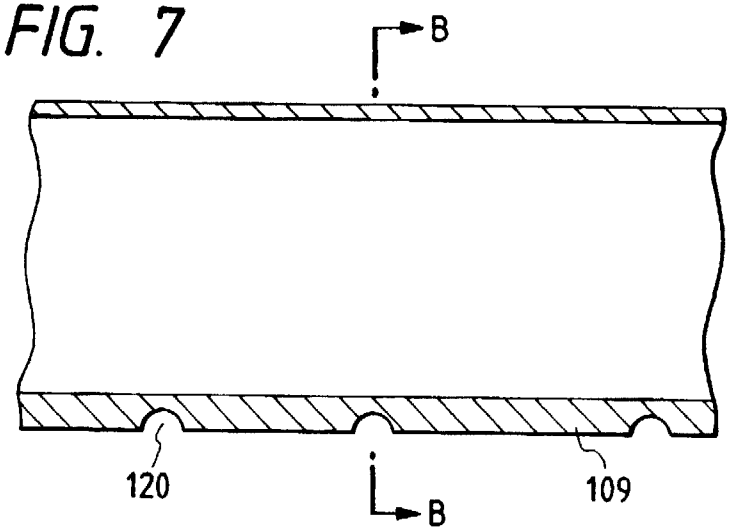
FIG. 7 is a sectional view of a modified inner tube.

In the case where the inner tube 109 is made of resin, one side of the inner tube 109 may be formed into a thicker-wall structure as shown in FIGS. 7 and 8. In this case, the engagement recesses 120 are formed in the thicker-wall side of the inner tube 109. Further, since the cross section of the inner tube 109 differs from a true circle, the inner tube 109 is prevented from rotating circumferentially relative to the outer tube 108.

Second Embodiment

Figure 9:
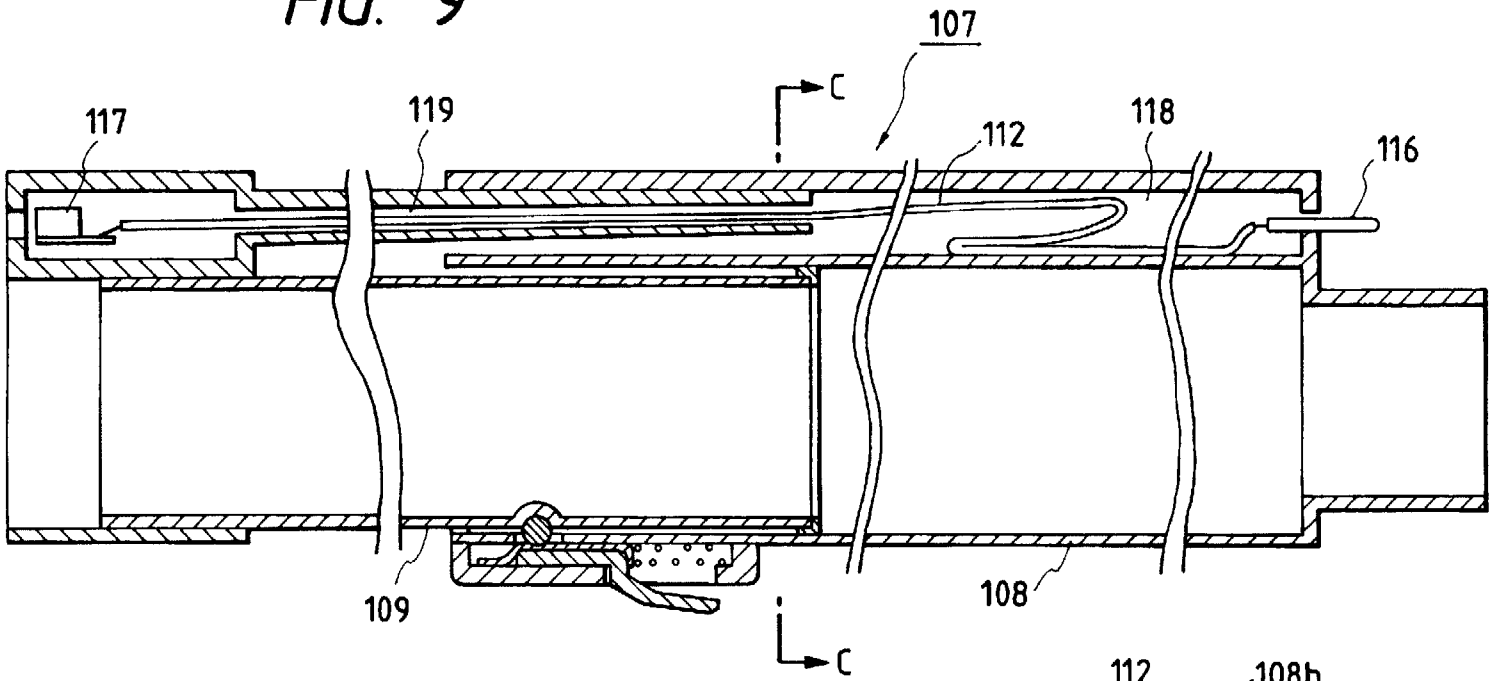
FIG. 9 is a sectional view of an extension pipe according to a second embodiment of this invention.
Figure 10:
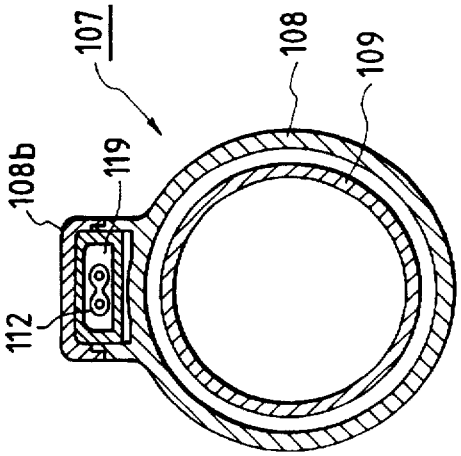
FIG. 10 is a sectional view of the extension pipe taken along the line C—C in FIG. 9.
Figure 11:
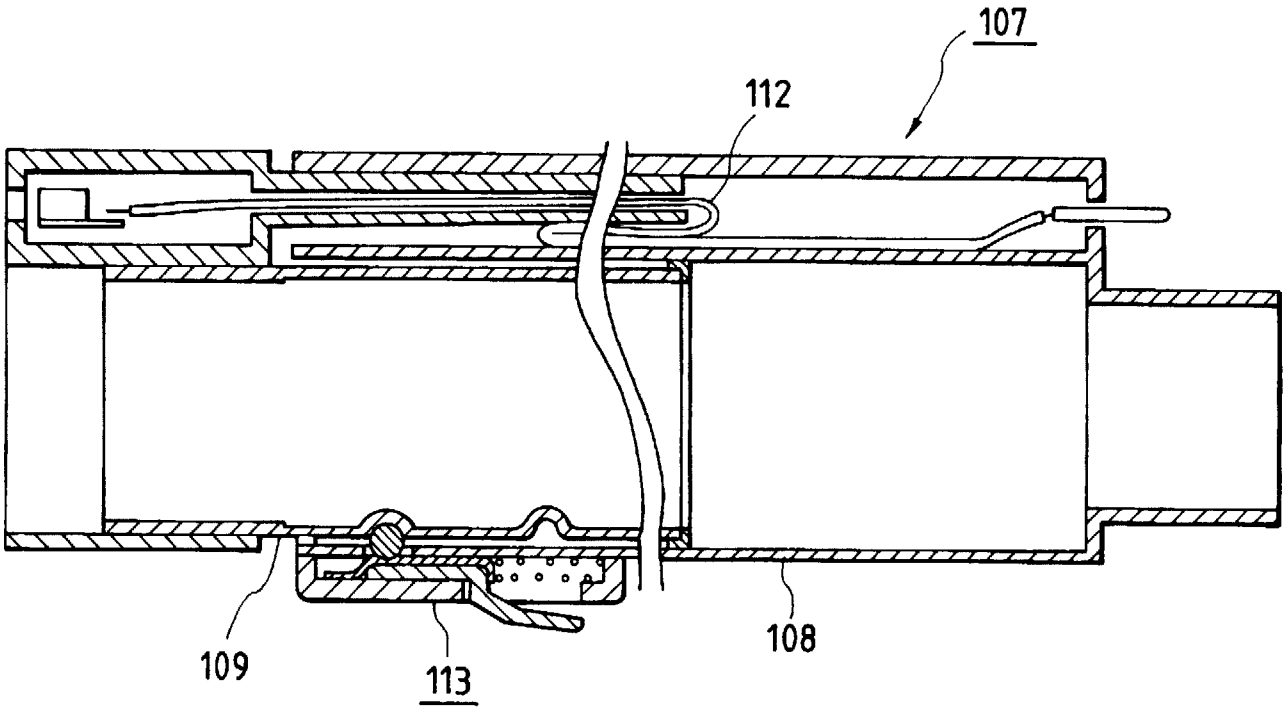
FIG. 11 is a sectional view of the extension pipe in the second embodiment of this invention.

FIGS. 9, 10, and 11 show a second embodiment of this invention which is similar to the embodiment of FIGS. 1–6 except for a design change indicated hereinafter.

In the embodiment of FIGS. 9–11, electric conductors 112 are folded at least one position in an axial direction. Thereby, the electric conductors 112 can easily bend in the axial direction, and the electric conductors 112 can be more durable.

In the embodiment of FIGS. 9–11, at least portions of the electric conductors 112 use a flexible flat cable containing at least a couple of electric wires. FIG. 9 shows that an extension pipe 107 is in a fully expanded state where the flat cable 112 folds back in an axial direction at least one or two positions within a conductor casing 118 in an outer tube 108. FIG. 11 shows that the extension pipe 107 is in a fully contracted state.

Since the flat cable 112 is thin, the heights (the radial dimensions) of the conductor casing 118 and a conductor casing 119 can be minimized. The flat cable 112 is excellently flexible and durable.

The electric conductors 112 extending between terminals 116 and terminals 117 may use an flexible flat cable. Portions of the electric conductors 112 which extend in the conductor casing 119 may use general electric wires.

Third Embodiment

Figure 12:
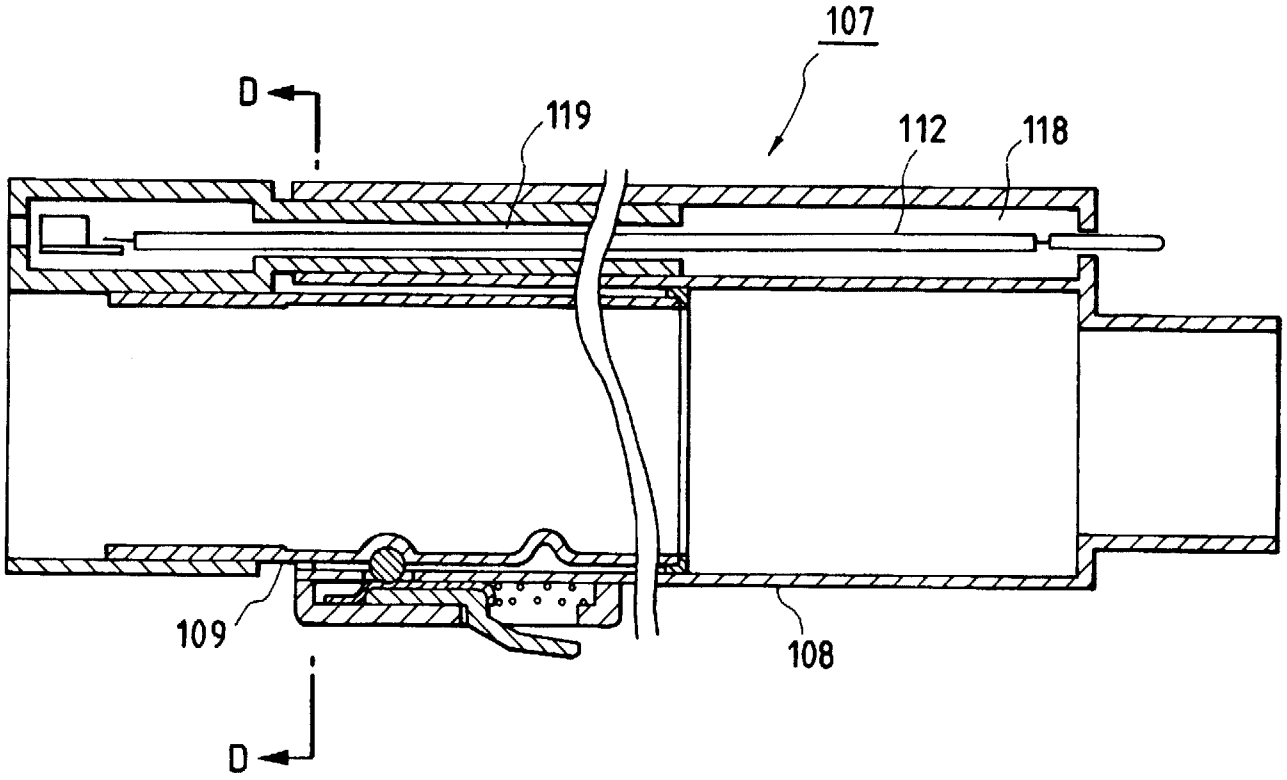
FIG. 12 is a sectional view of an extension pipe according to a third embodiment of this invention.
Figure 13:
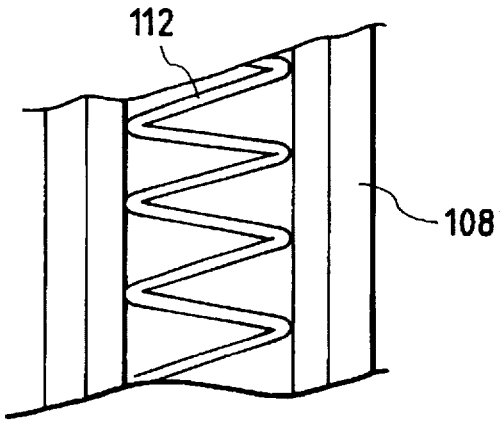
FIG. 13 is a plan view of an electric conductor and related members in FIG. 12.
Figure 14:
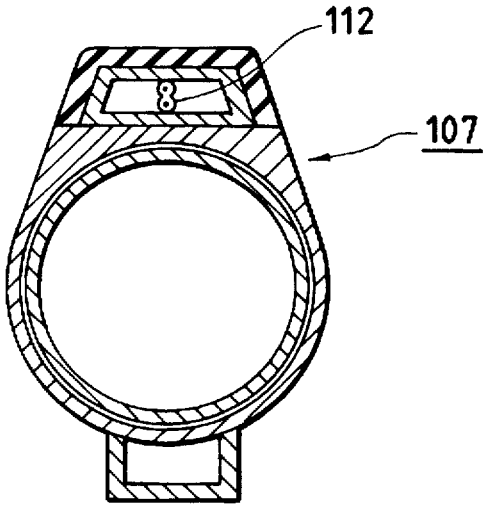
FIG. 14 is a sectional view of the extension pipe taken along the line D—D in FIG. 12.

FIGS. 12, 13, and 14 show a third embodiment of this invention which is similar to the embodiment of FIGS. 9–11 except for a design change indicated hereinafter.

In the embodiment of FIGS. 12–14, electric conductors 112 use a flexible flat cable containing at least a couple of electric wires. The width direction of the flat cable 112 is set in agreement with the radial direction of an extension pipe 107. When the extension pipe 107 is contracted, the flat cable 112 folds in zigzag in a conductor casing 118 as shown in FIG. 13. The central line of the zigzag configuration of the flat cable 112 extends along the axial direction. In this embodiment, the axial dimension of the conductor casing 118 can be small.

Fourth Embodiment

Figure 15:
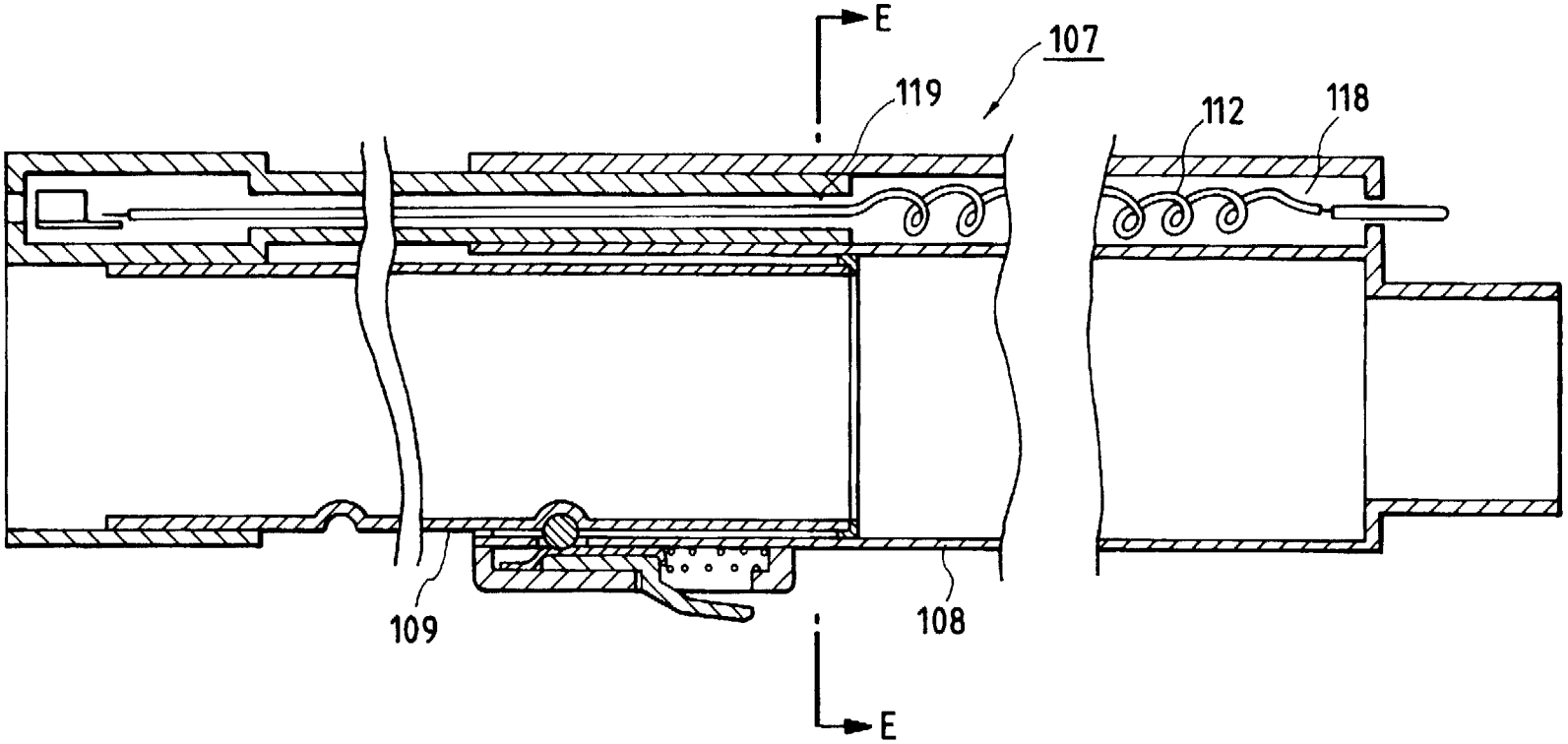
FIG. 15 is a sectional view of an extension pipe according to a fourth embodiment of this invention.
Figure 16:
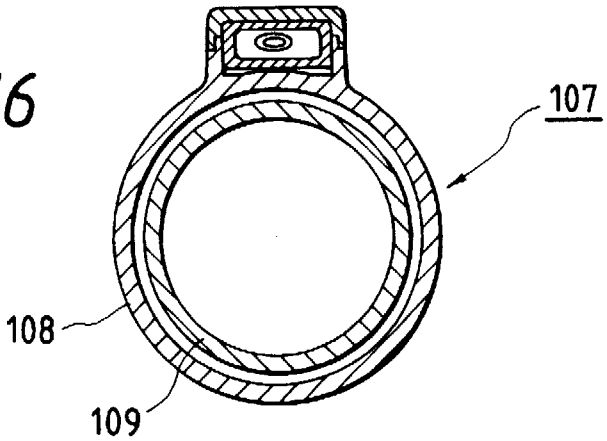
FIG. 16 is a sectional view of the extension pipe taken along the line E—E in FIG. 15.
Figure 17:
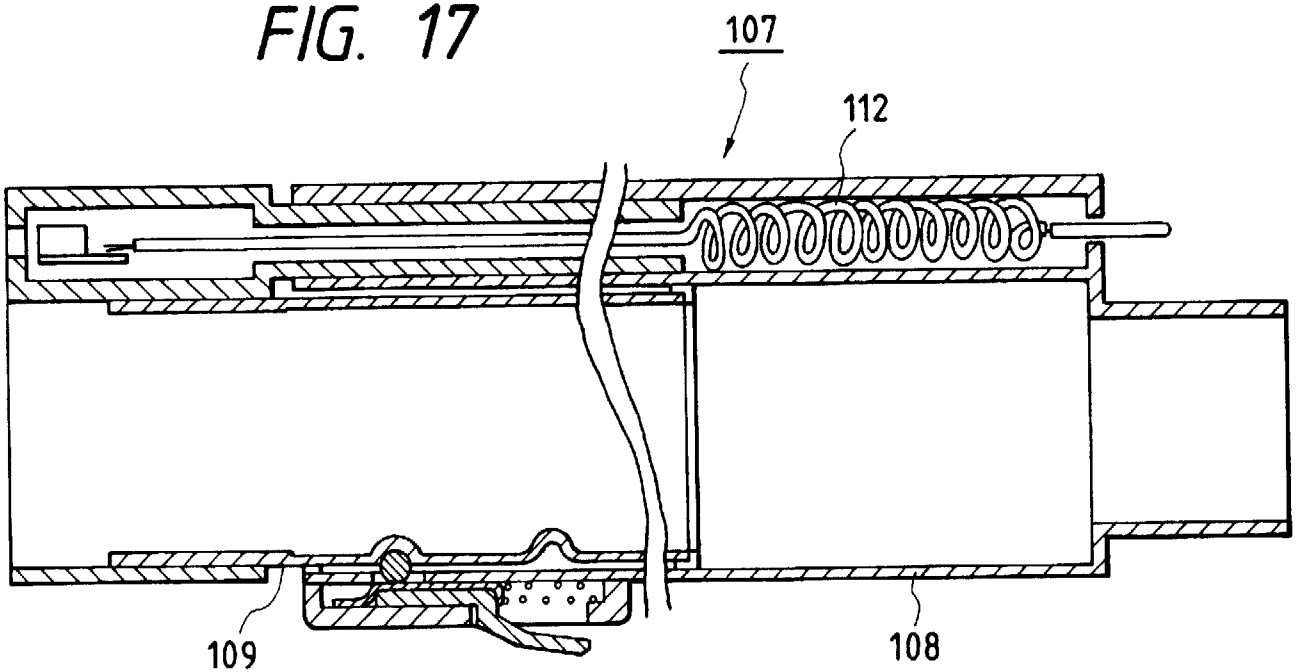
FIG. 17 is a sectional view of the extension pipe in the fourth embodiment of this invention.

FIGS. 15, 16, and 17 show a fourth embodiment of this invention which is similar to the embodiment of FIGS. 1–6 except for a design change indicated hereinafter.

In the embodiment of FIGS. 15–17, portions of electric conductors 112 which extend in a conductor casing 118 use an expandible and contractible member having a coil shape or a helical shape. FIG. 15 shows that an extension pipe 107 is in a fully expanded state. FIG. 17 shows that the extension pipe 107 is in a fully contracted state where the electric conductors 112 are contracted in the form of a coil or a helix within the conductor casing 118.

It should be noted that wholes of the electric conductors 112 may use an expandible and contractible member having a coil shape or a helical shape.

Figure 18:
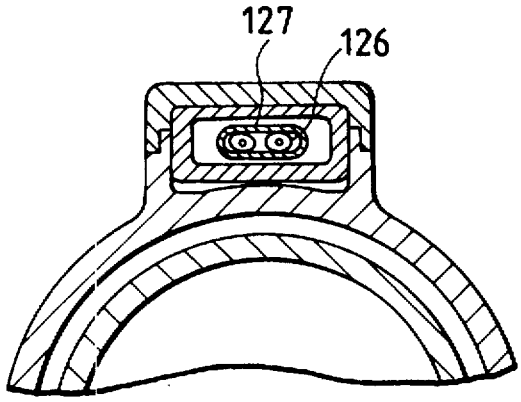
FIG. 18 is a sectional view of a modified expandible and contractible member and related members.

The expandible and contractible member 112 may be of a structure shown in FIG. 18. In this case, the expandible and contractible member 112 includes coil-shaped conductors 126 and an expandible and contractible tube 127 accommodating the coil-shaped conductors 126.

Figure 19:
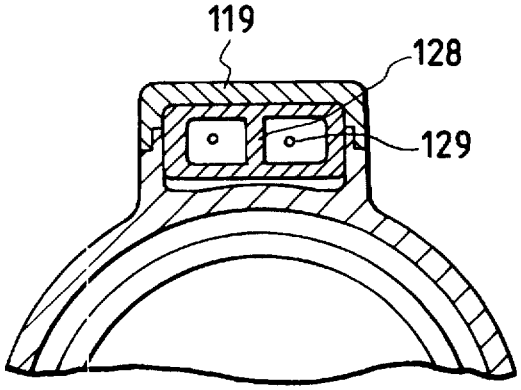
FIG. 19 is a sectional view of a modified conductor casing in an inner tube.

As shown in FIG. 19, the interior of a conductor casing 119 in an inner tube 109 may be separated by a partition wall 128 into two axially-extending spaces in which insulated wires 129 forming portions of the electric conductors 112 are disposed of respectively.

In the case where the conductor casing 119 in the inner tube 109 is made of a molded resin having a partition wall 129, portions of the electric conductors 112 which extend in the conductor casing 119 may be bare wires.

Fifth Embodiment

Figure 21:
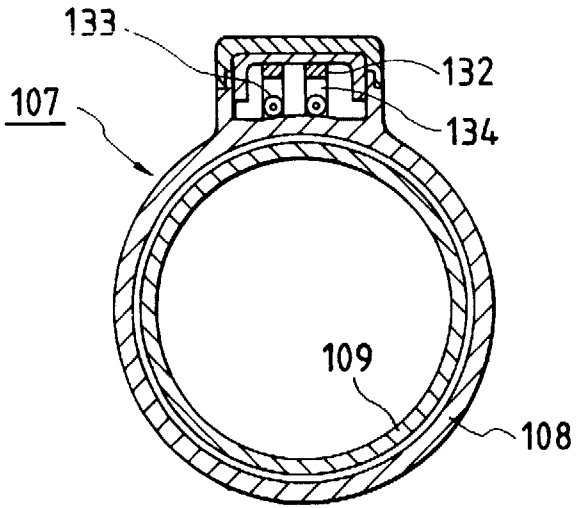
FIG. 21 is a sectional view of the extension pipe taken along the line F—F in FIG. 20.
Figure 20:
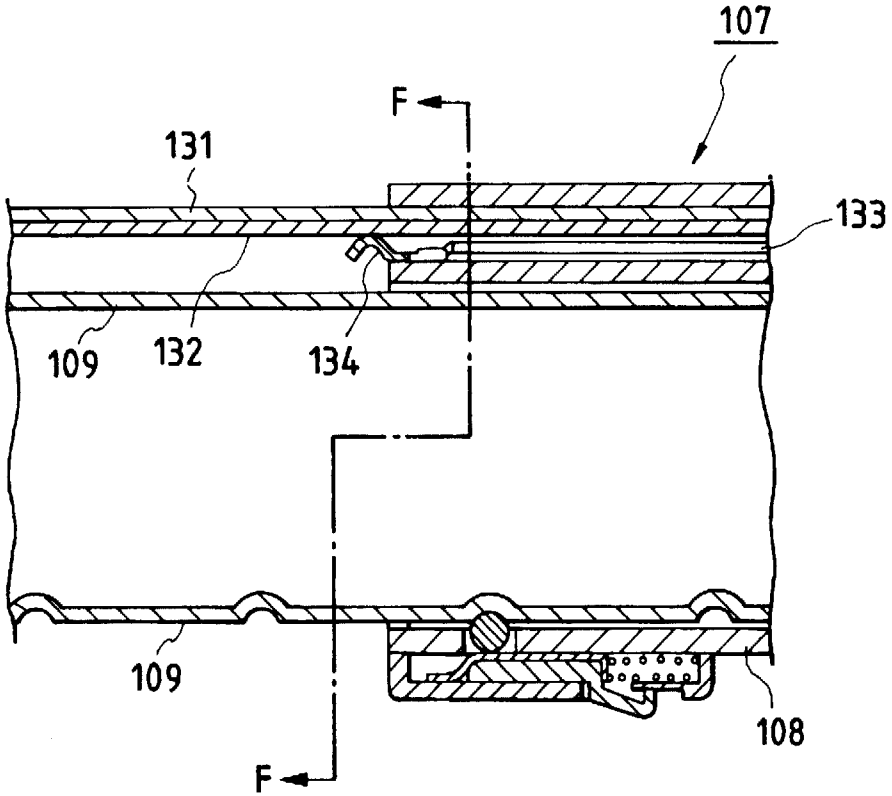
FIG. 20 is a sectional view of an extension pipe according to a fifth embodiment of this invention.

FIGS. 20 and 21 show a fifth embodiment of this invention which is similar to the embodiment of FIGS. 1–6 except for design changes indicated hereinafter.

In the embodiment of FIGS. 20 and 21, an inner tube 109 is provided with an axially-extending protective cover 131 made of insulating material such as resin. Axially-extending electric conductors 132 leading from terminals 117 (see FIG. 3) are fixed to inner surfaces of the protective cover 131. The electric conductors 132 are similar in shape to rails.

Axially-extending electric conductors 133 have first ends connected to terminals 116 (see FIG. 3), and second ends connected to resilient contacts 134. The contacts 134 are in touch with the electric conductors 132 respectively. The contacts 134 can slide relative to the electric conductors 132.

As the inner tube 109 is moved relative to an outer tube 108 to expand and contract an extension pipe 107, the contacts 134 slide relative to the electric conductors 132 while remaining in touch therewith.

In the embodiment of FIGS. 20 and 21, spaces for accommodating the electric conductors 132 and 133 can be small. This is advantageous in miniaturizing and lightening the extension pipe 107.

Sixth Embodiment

Figure 23:
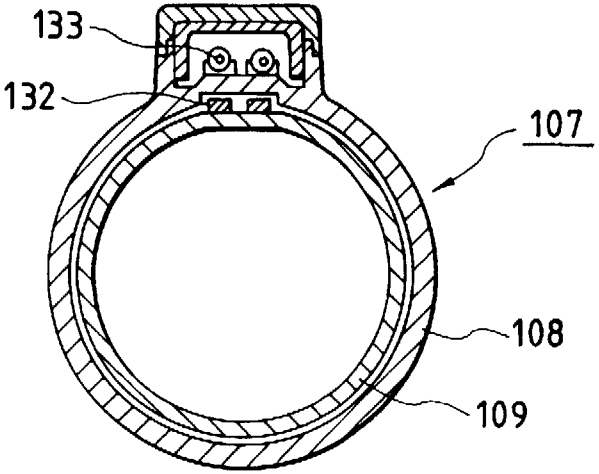
FIG. 23 is a sectional view of the extension pipe taken along the line G—G in FIG. 22.
Figure 22:
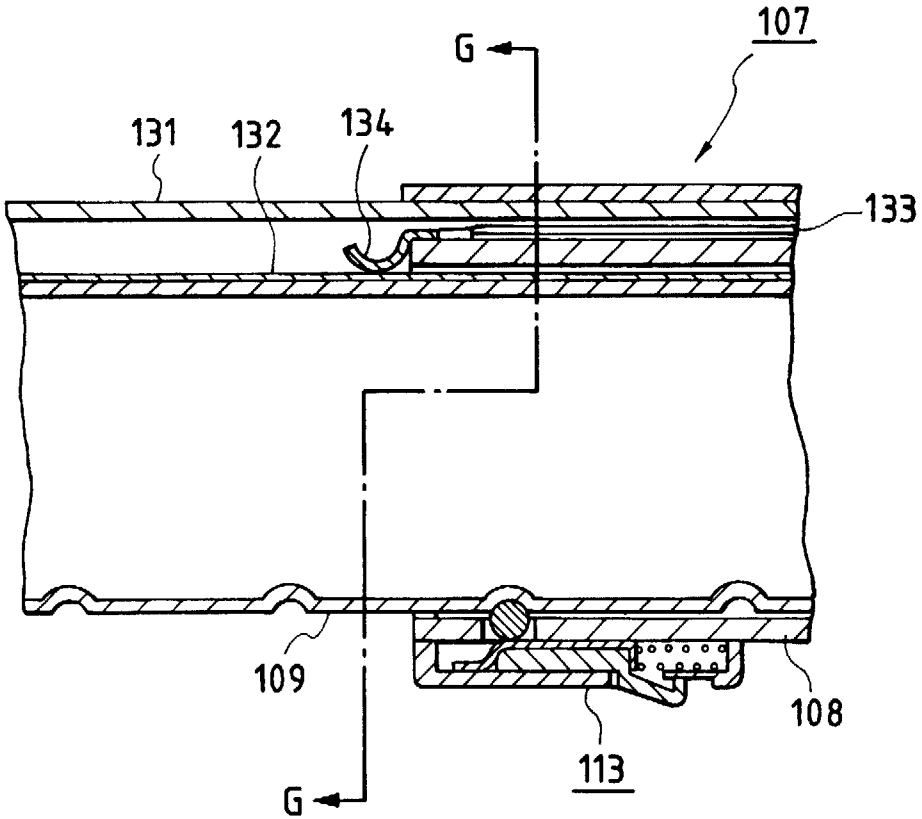
FIG. 22 is a sectional view of an extension pipe according to a sixth embodiment of this invention.

FIGS. 22 and 23 show a sixth embodiment of this invention which is similar to the embodiment of FIGS. 1–6 except for design changes indicated hereinafter.

In the embodiment of FIGS. 22 and 23, an inner tube 109 is provided with an axially-extending protective cover 131 made of insulating material such as resin. The protective cover 131 conceals axially-extending electric conductors 132 leading from terminals 117 (see FIG. 3). The electric conductors 132 are fixed to outer surfaces of walls of a main portion of the inner tube 109. The electric conductors 132 are similar in shape to rails.

Axially-extending electric conductors 133 have first ends connected to terminals 116 (see FIG. 3), and second ends connected to resilient contacts 134. The contacts 134 are in touch with the electric conductors 132 respectively. The contacts 134 can slide relative to the electric conductors 132.

As the inner tube 109 is moved relative to an outer tube 108 to expand and contract an extension pipe 107, the contacts 134 slide relative to the electric conductors 132 while remaining in touch therewith.

In the embodiment of FIGS. 22 and 23, spaces for accommodating the electric conductors 132 and 133 can be small. This is advantageous in miniaturizing and lightening the extension pipe 107.

In the case where the walls of the main portion of the inner tube 109 are made of highly rigid material, the electric conductors 132 are hardly deformed. This is advantageous in maintaining a reliable connection between the electric conductors 132 and the contacts 134.

Seventh Embodiment

Figure 24:
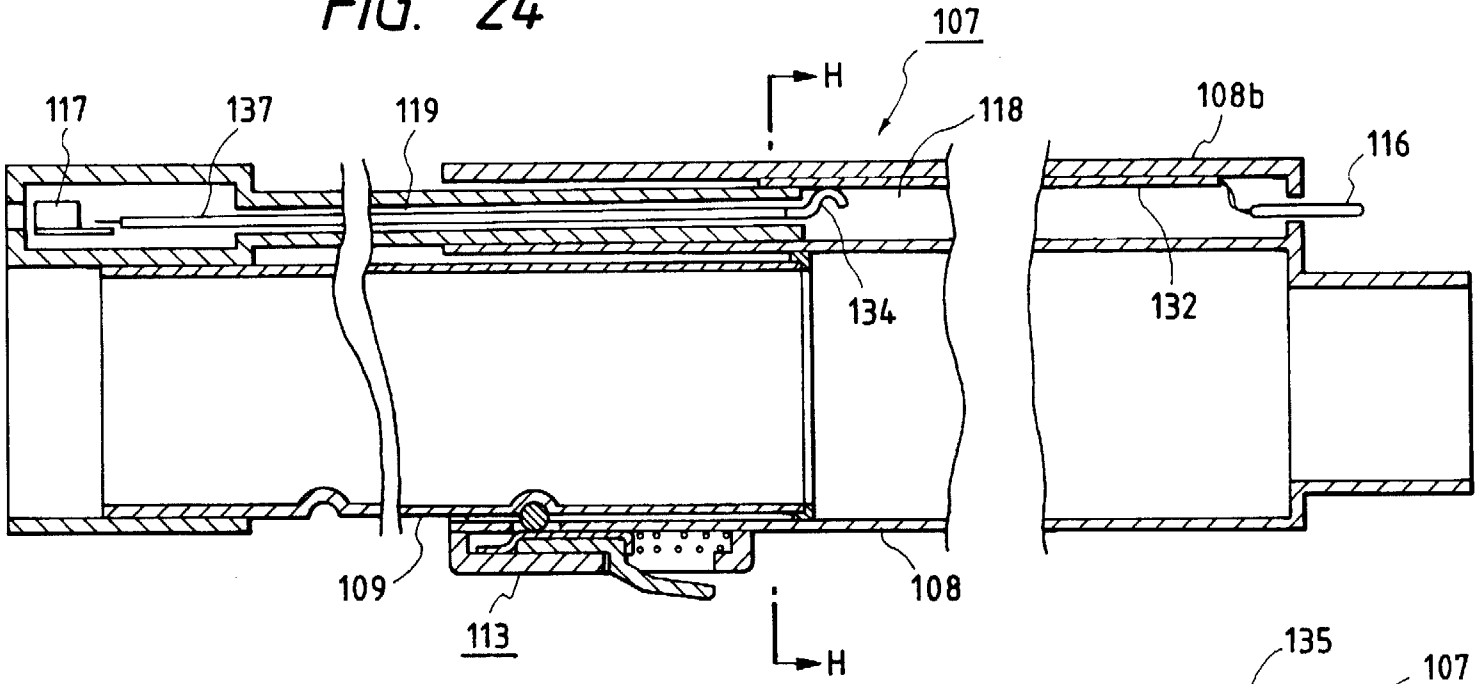
FIG. 24 is a sectional view of an extension pipe according to a seventh embodiment of this invention.
Figure 25:
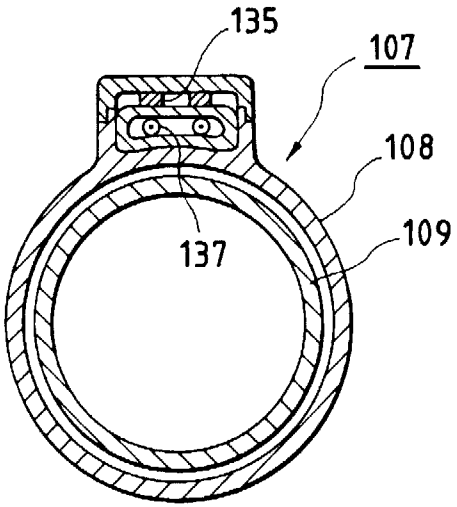
FIG. 25 is a sectional view of the extension pipe taken along the line H—H in FIG. 24.

FIGS. 24 and 25 showy a seventh embodiment of this invention which is similar to the embodiment of FIGS. 1–6 except for design changes indicated hereinafter.

In the embodiment of FIGS. 24 and 25, axially-extending electric conductors 132 leading from terminals 116 are fixed to inner surfaces of cover walls **108*b* of a conductor casing 118 in an outer tube 108. The electric conductors 132** are similar in shape to rails.

A conductor casing 119 in an inner tube 109 accommodates axially-extending electric conductors 137 which have first ends connected to terminals 117, and second ends connected to resilient contacts 134. The contacts 134 are located at an end of the conductor casing 119. It is preferable that the contacts 134 are located in the conductor casing 118 in the outer tube 108. The contacts 134 are in touch with the electric conductors 132 respectively. The contacts 134 can slide relative to the electric conductors 132.

As the inner tube 109 is moved relative to an outer tube 108 to expand and contract an extension pipe 107, the contacts 134 slide relative to the electric conductors 132 while remaining in touch therewith.

Since the contacts 134 are located in the conductor casing 118 in the outer tube 108, the height (the radial dimension) of the conductor casing 119 in the inner tube 109 can be small.

Eighth Embodiment

Figure 26:
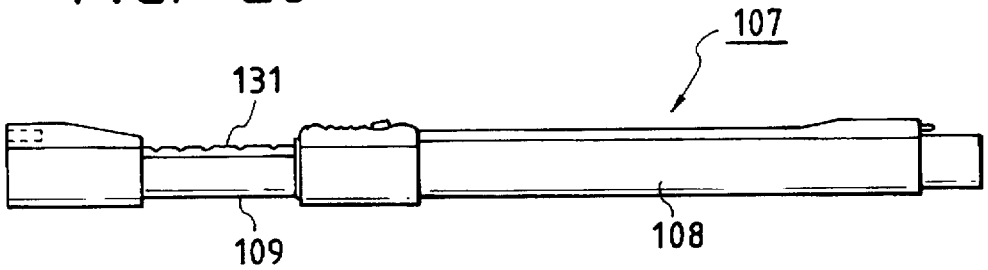
FIG. 26 is a side view of an extension pipe according to an eighth embodiment of this invention.
Figure 27:
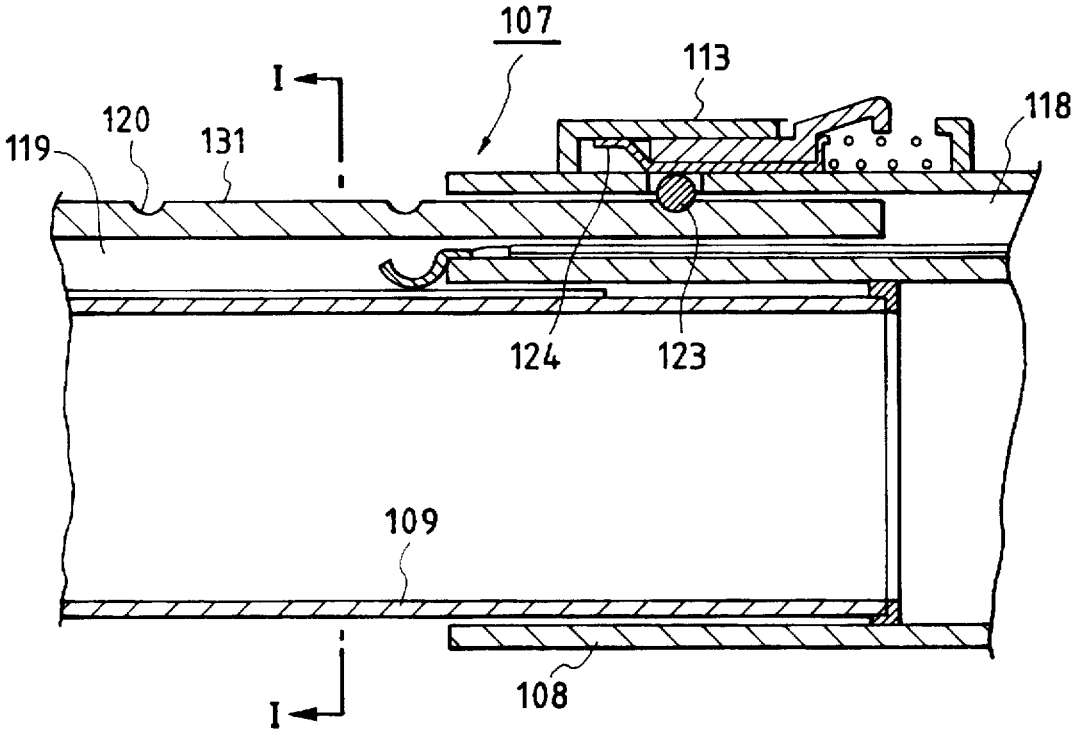
FIG. 27 is a sectional view of the extension pipe in FIG. 26.
Figure 28:
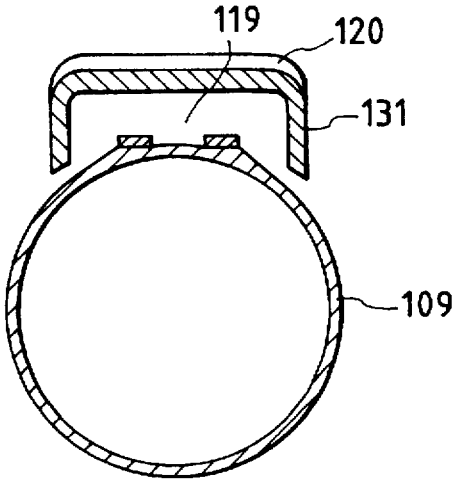
FIG. 28 is a sectional view of the extension pipe taken along the line I—I in FIG. 27.

FIGS. 26, 27, and 28 show an eighth embodiment of this invention which is similar to the embodiment of FIGS. 22–23 except for design changes indicated hereinafter.

In the embodiment of FIGS. 26–28, an adjustment mechanism 113 for adjusting the position of an inner tube 109 relative to an outer tube 108 is provided on a side of an extension pipe 107 in which conductor casings 118 and 119 extend. The adjustment mechanism 113 has a major portion including an engagement member 123 and a pressing plate 124. The major portion of the adjustment mechanism 113 is provided on the conductor casing 118 in the outer tube 108. Engagement recesses 120 are formed in outer surfaces of a protective cover 131 which forms a part of the conductor casing 119 in the inner tube 109.

Since the engagement recesses 120 separate from a main portion of the inner tube 109, the inner tube 109 can be made into a simple shape. This is advantageous in providing a wide cross-sectional area of the main portion of the inner tube 109, and lowering a resistance to an air flow in the main portion of the inner tube 109.

Ninth Embodiment

Figure 29:
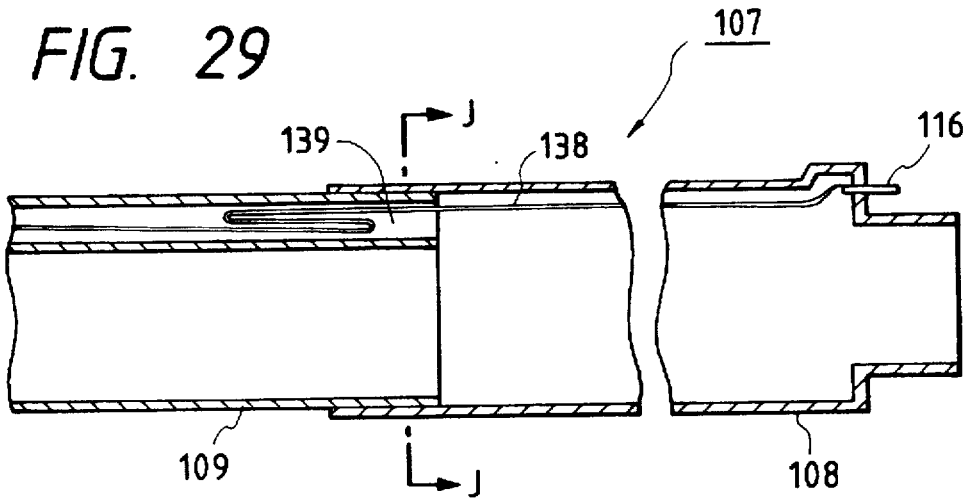
FIG. 29 is a sectional view of an extension pipe according to a ninth embodiment of this invention.
Figure 30:
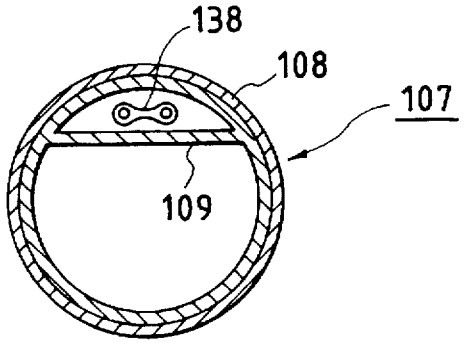
FIG. 30 is a sectional view of the extension pipe taken along the line J—J in FIG. 29.

FIGS. 29 and 30 show a ninth embodiment of this invention which is similar to the embodiment of FIGS. 1–6 except for design changes indicated hereinafter.

In the embodiment of FIGS. 29 and 30, an end of an outer tube 108 near a handle portion 104 (see FIG. 1) is provided with terminals 116 for electric connection with the handle portion 104. An end of an inner tube 109 near a floor nozzle device 111 (see FIG. 1) is provided with terminals 117 (see FIG. 1) for electric connection with a motor-driven brush 110 (see FIG. 1) in the floor nozzle device 111 (see FIG. 1). Electric conductors 138 extend between the terminals 116 and the terminals 117 (see FIG. 1).

It is preferable that the electric conductors 138 use a flexible flat cable containing a pair of electric wires as shown in FIG. 30. The inner tube 109 is provided with an axially-extending conductor casing 139 in which portions of the electric conductors 138 are disposed. The conductor casing 139 is integral with a main portion of the inner tube 109. As shown in FIG. 29, the electric conductors 138 are previously folded in the conductor casing 139.

As the inner tube 109 is forced into the outer tube 108, the electric conductors 138 relatively move into the conductor casing 139.

The interior of the conductor casing 139 is separated from an interior of a main portion of the inner tube 109 by partition walls integral with the walls of the conductor casing 139 and the inner tube 109. The partition walls increase the rigidity of the inner tube 109.

The flat cable 138 is thin, and is excellent in flexibility. The flat cable 138 easily folds. The flat cable 138 is durable.

Tenth Embodiment

Figure 31:
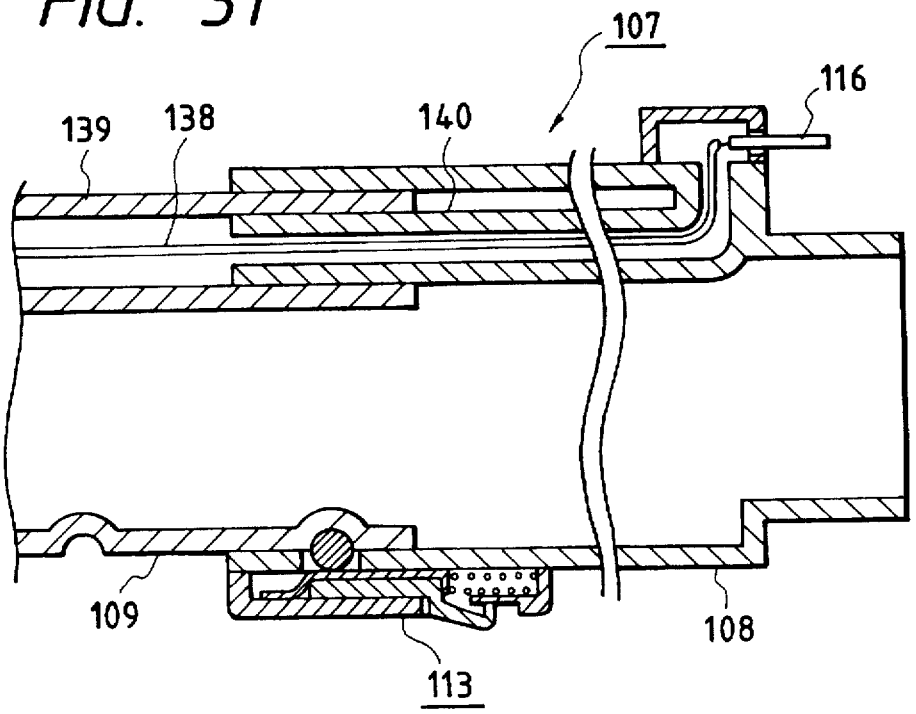
FIG. 31 is a sectional view of an extension pipe according to a tenth embodiment of this invention.
Figure 33:
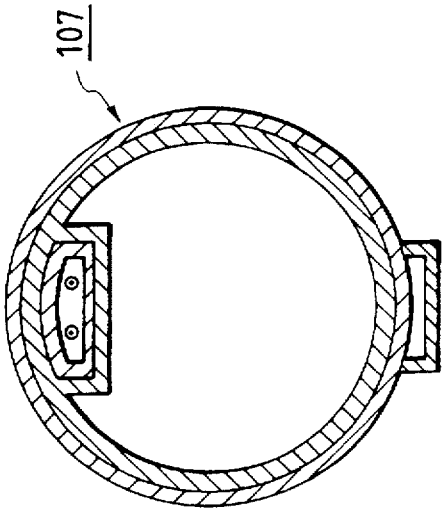
FIG. 33 is a sectional view of the extension pipe taken along the line K—K in FIG. 32.
Figure 32:
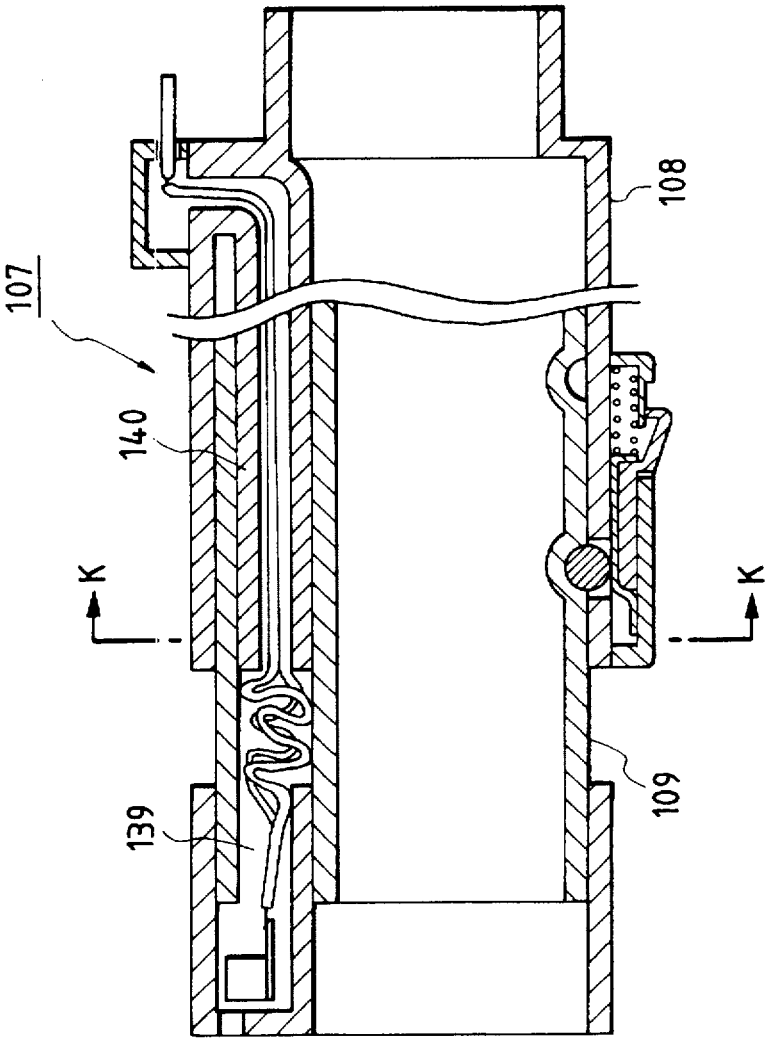
FIG. 32 is a sectional view of the extension pipe in the tenth embodiment of this invention.

FIGS. 31, 32, and 33 show a tenth embodiment of this invention which is similar to the embodiment of FIGS. 1–6 or the embodiment of FIGS. 29 and 30 except for design changes indicated hereinafter.

In the embodiment of FIGS. 31–33, flexible electric conductors 138 extend between terminals 116 and terminals 117 (see FIG. 1). An outer tube 108 has an axially-extending sub tube 140 which forms a conductor casing for accommodating portions of the electric conductors 138. The sub tube 140 is integral with a main portion of the outer tube 108. Specifically, the sub tube 140 is disposed in an inner space defined by the cylindrical main walls of the outer tube 108. The walls of the sub tube 140 and the walls of the main portion of the outer tube 108 meet at an end of the outer tube 108.

One side of an inner tube 109 is provided with an axially-extending conductor casing 139 which accommodates portions of the electric conductors 138. The conductor casing 139 is integral with a main portion of the inner tube 109.

The sub tube 140 in the outer tube 108 slidably extends into the conductor casing 139 in the inner tube 109. The cylindrical walls of the sub tube 140 and the cylindrical main walls of the outer tube 108 define a space therebetween into which the outer walls of the conductor casing 139 in the inner tube 109 slidably extend.

An adjustment mechanism 113 for adjusting the position of the inner tube 109 relative to the outer tube 108 is provided on a side of an extension pipe 107 opposite the electric conductors 138.

FIG. 31 shows that the extension pipe 107 is in a fully expanded state. FIG. 32 shows that the extension pipe 107 is in a fully contracted state where the electric conductors 138 fold in the conductor casing 139.

The electric conductors 138 in the inner tube 109 are protected by the conductor casing 139. The electric conductors 138 in the outer tube 108 are protected by both the sub tube 140 and the walls of the outer tube 108.

It is preferable that the walls of the sub tube 140 and the walls of the main portion of the outer tube 108 are simultaneously formed by a molding process using resin. The sub tube 140 may be individually molded or assembled. In this case, the molded or assembled sub tube 140 is bonded or fixed to the walls of the main portion of the outer tube 108. It is preferable that the sub tube 140 is made of resin. The sub tube 140 may be made of metal such as aluminum.

Eleventh Embodiment

Figure 35:
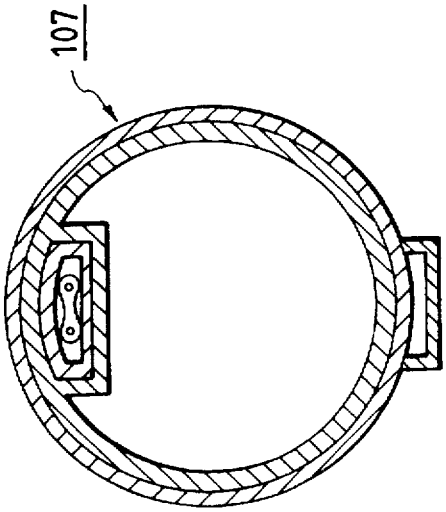
FIG. 35 is a sectional view of the extension pipe taken along the line L—L in FIG. 34.
Figure 34:
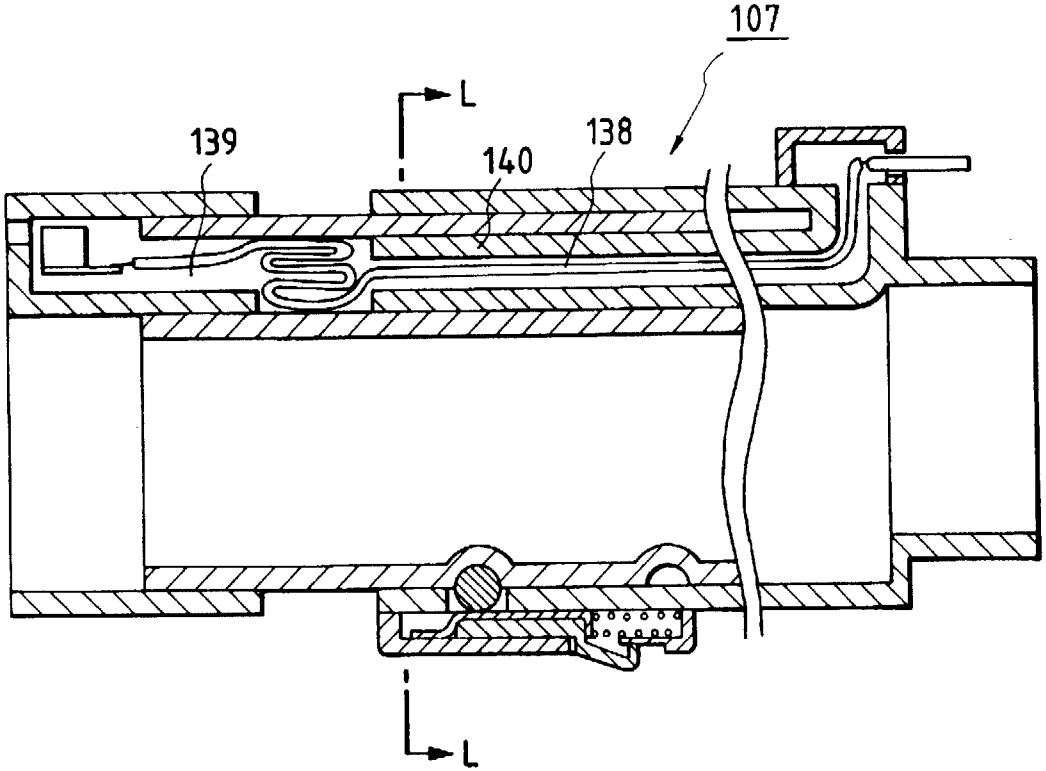
FIG. 34 is a sectional view of an extension pipe according to an eleventh embodiment of this invention.

FIGS. 34 and 35 show an eleventh embodiment of this invention which is similar to the embodiment of FIGS. 31–33 except for a design change indicated hereinafter.

In the embodiment of FIGS. 34 and 35, electric conductors 138 use a flexible flat cable containing a pair of electric wires. FIG. 34 shows that an extension pipe 107 is in a fully contracted state where the flat cable 138 folds in a conductor casing 139. The flat cable 138 is excellent in flexibility, and is durable.

Twelfth Embodiment

Figure 37:
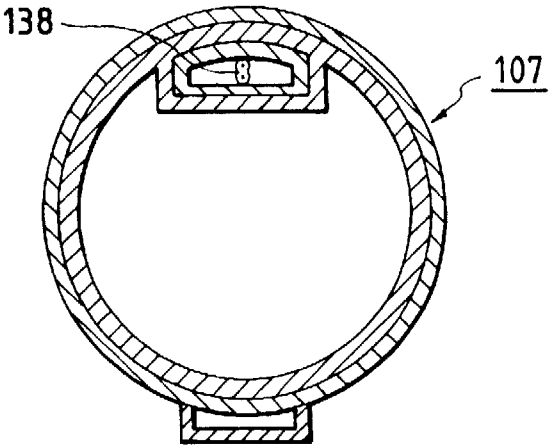
FIG. 37 is a sectional view of the extension pipe taken along the line M—M in FIG. 36.
Figure 36:
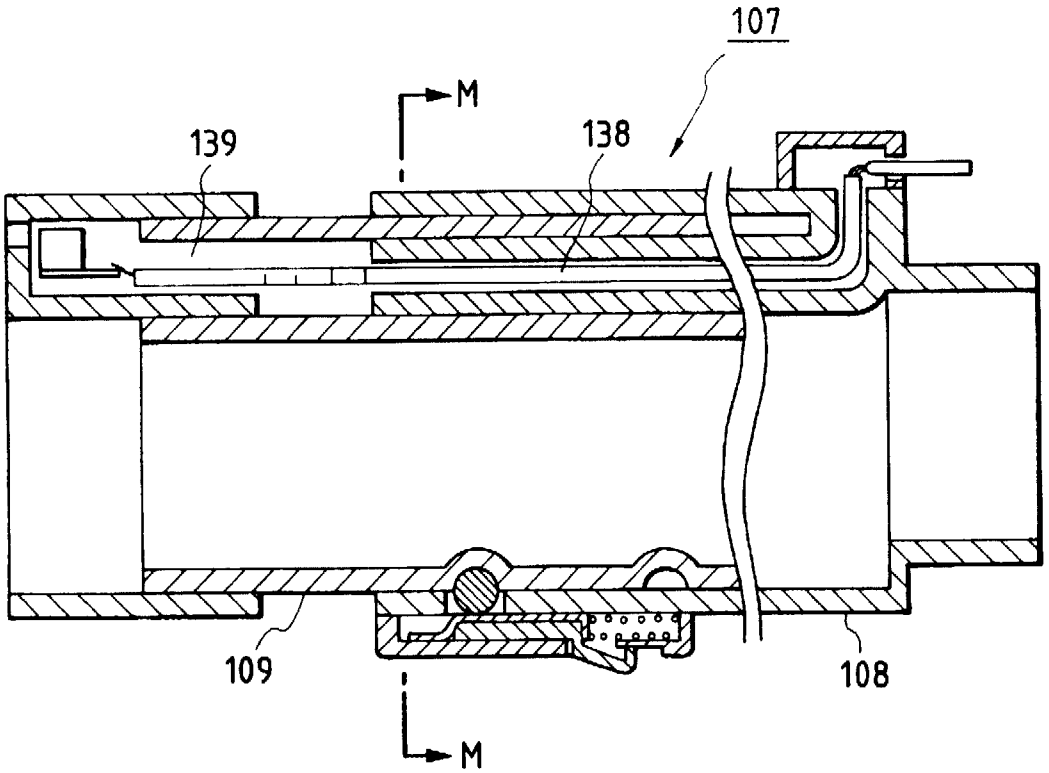
FIG. 36 is a sectional view of an extension pipe according to a twelfth embodiment of this invention.
Figure 38:
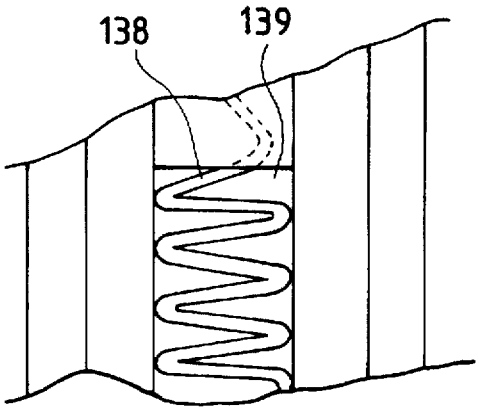
FIG. 38 is a plan view of an electric conductor and related members in FIG. 36.

FIGS. 36, 37, and 38 show a twelfth embodiment of this invention which is similar to the embodiment of FIGS. 34 and 35 except for a design change indicated hereinafter.

In the embodiment of FIGS. 36–38, electric conductors 138 use a flexible flat cable containing a couple of electric wires. The width direction of the flat cable 138 is set in agreement with the radial direction of an extension pipe 107. When the extension pipe 107 is contracted, the flat cable 138 folds in zigzag in a conductor casing 139 as shown in FIG. 38. The central line of the zigzag configuration of the flat cable 138 extends along the axial direction. In this embodiment, the axial dimension of the conductor casing 139 can be small.

Thirteenth Embodiment

Figure 39:
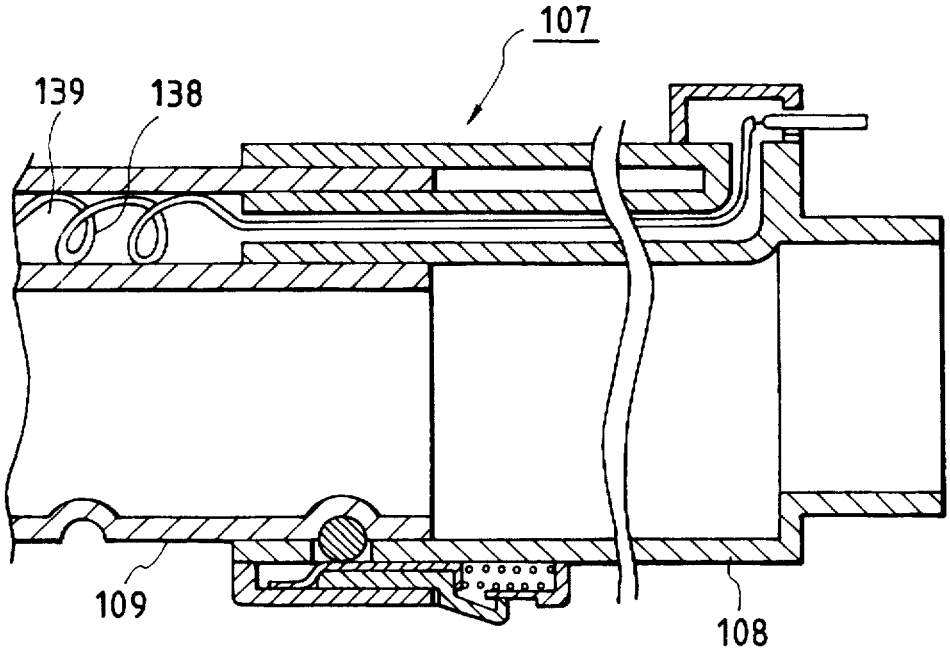
FIG. 39 is a sectional view of an extension pipe according to a thirteenth embodiment of this invention.
Figure 40:
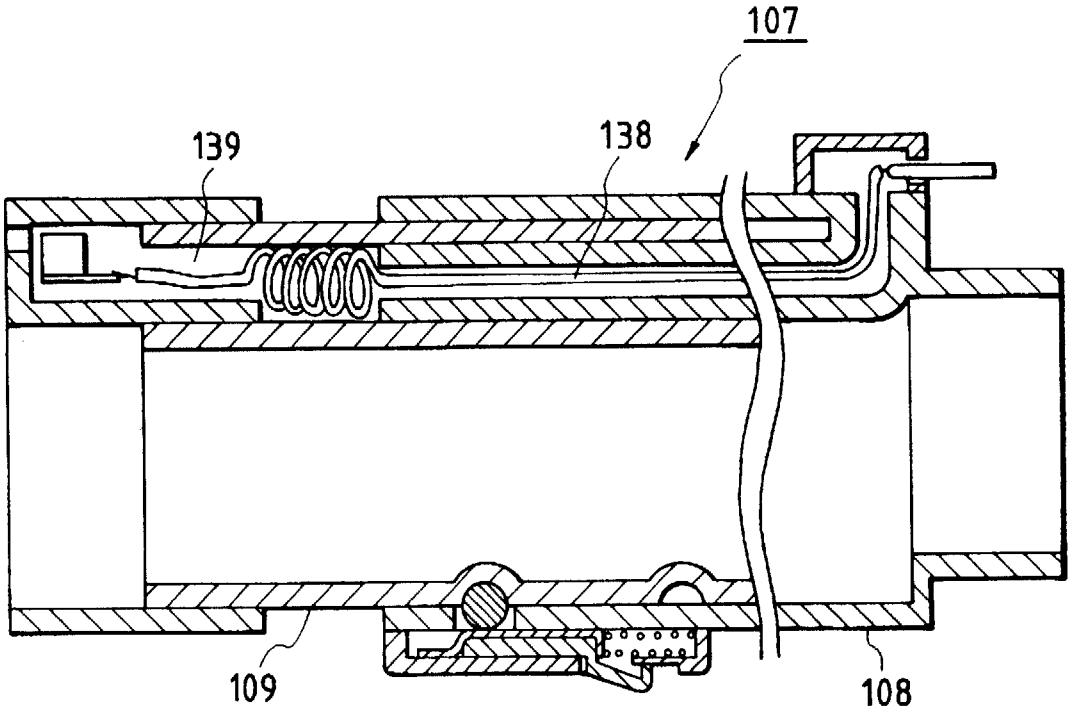
FIG. 40 is a sectional view of the extension pipe in the thirteenth embodiment of this invention.

FIGS. 39 and 40 show a thirteenth embodiment of this invention which is similar to the embodiment of FIGS. 31–33 except for a design change indicated hereinafter.

In the embodiment of FIGS. 39 and 40, portions of electric conductors 138 which extend in a conductor casing 139 use an expandible and contractible member having a coil shape or a helical shape. FIG. 39 shows that an extension pipe 107 is in a fully expanded state. FIG. 40 shows that the extension pipe 107 is in a fully contracted state where the electric conductors 138 are contracted in the form of a coil or a helix within the conductor casing 139.

It should be noted that wholes of the electric conductors 138 may use an expandible and contractible member having a coil shape or a helical shape.

The expandible and contractible member 138 may be of a structure including coil-shaped conductors and an expandible and contractible tube accommodating the coil-shaped conductors as in the embodiment of FIG. 18.

The expandible and contractible member provides a high durability of the electric conductors 138. The expandible and contractible member of the electric conductors 138 is disposed in the conductor casing 139. This is advantageous in providing a high durability of the electric conductors 138.

Fourteenth Embodiment

Figure 41:
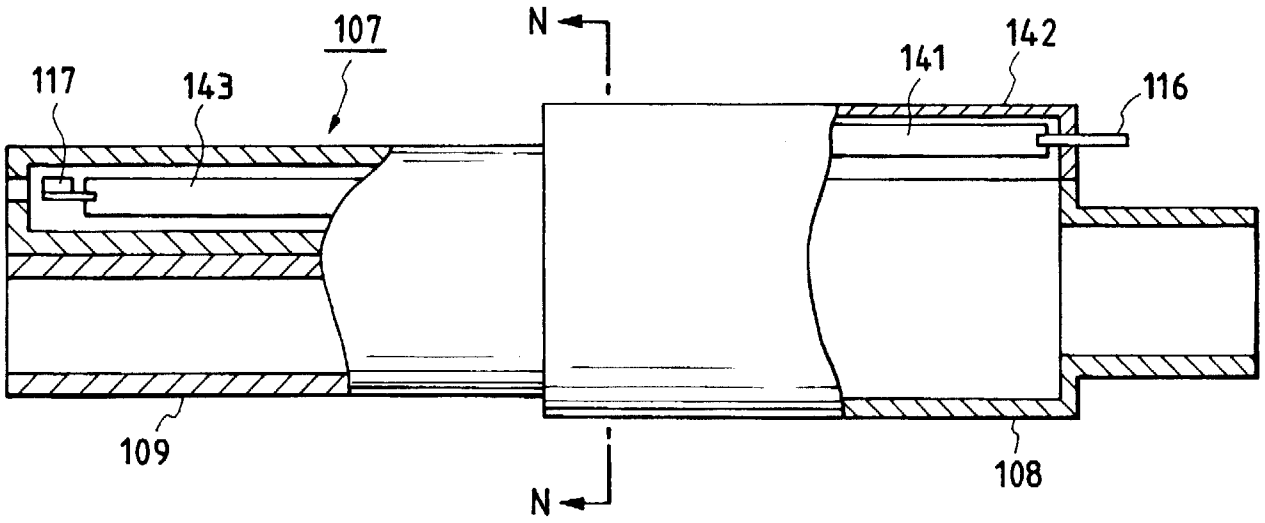
FIG. 41 is a sectional view of an extension pipe according to a fourteenth embodiment of this invention.
Figure 42:
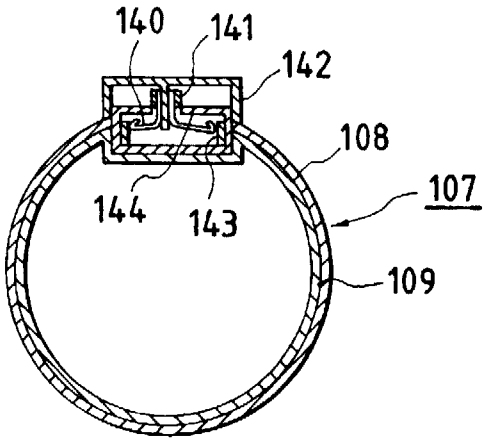
FIG. 42 is a sectional view of the extension pipe taken along the line N—N in FIG. 41.

FIGS. 41 and 42 show a fourteenth embodiment of this invention which is similar to the embodiment of FIGS. 1–6 except for design changes indicated hereinafter.

In the embodiment of FIGS. 41 and 42, a pair of electric conductors 141 extend axially along an outer tube 108. First ends of the electric conductors 141 are connected to terminals 116 respectively. Second ends of the electric conductors 141 are connected to contacts 140 made of resilient metal strips respectively. The electric conductors 141 are concealed by a cover 142 fixed to the outer tube 108.

A conductor casing 144 is fixed to an inner tube 109. The conductor casing 144 accommodates a pair of axially-extending electric conductors 143 leading from terminals 117 for electric connection with a floor nozzle device 111 (see FIG. 1). The contacts 140 are in touch with the electric conductors 143 respectively. The contacts 140 can slide relative to the electric conductors 143.

As the inner tube 109 is moved relative to the outer tube 108 to expand and contract an extension pipe 107, the contacts 140 slide relative to the electric conductors 143 while remaining in touch therewith.

Fifteenth Embodiment

Figure 43:
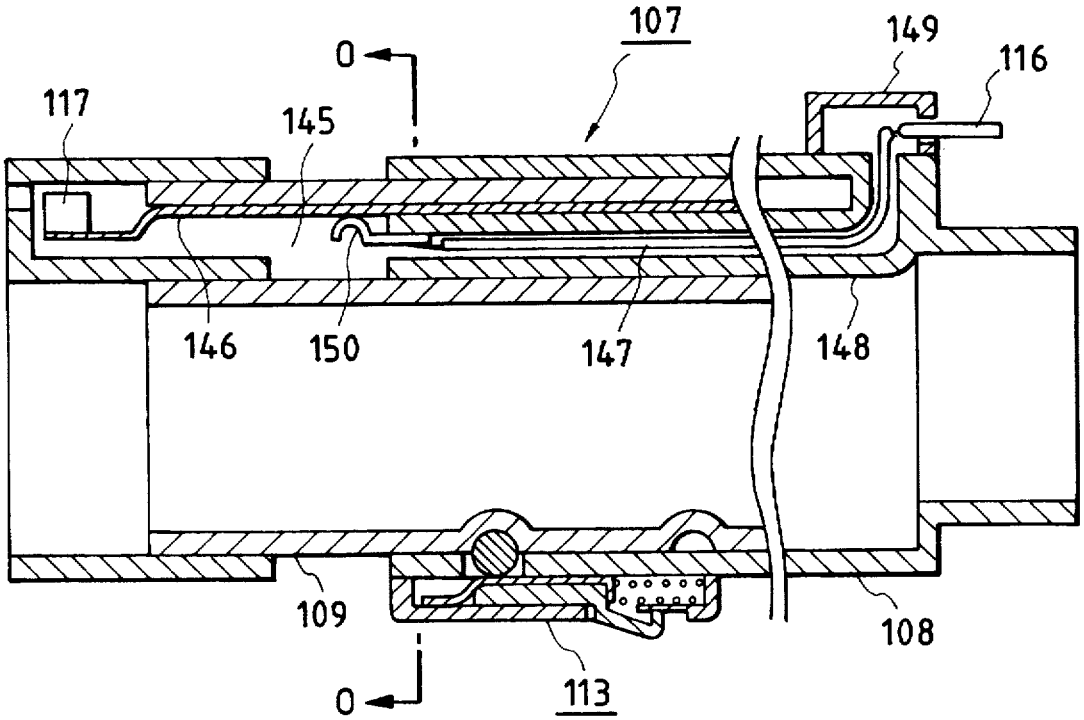
FIG. 43 is a sectional view of an extension pipe according to a fifteenth embodiment of this invention.
Figure 44:
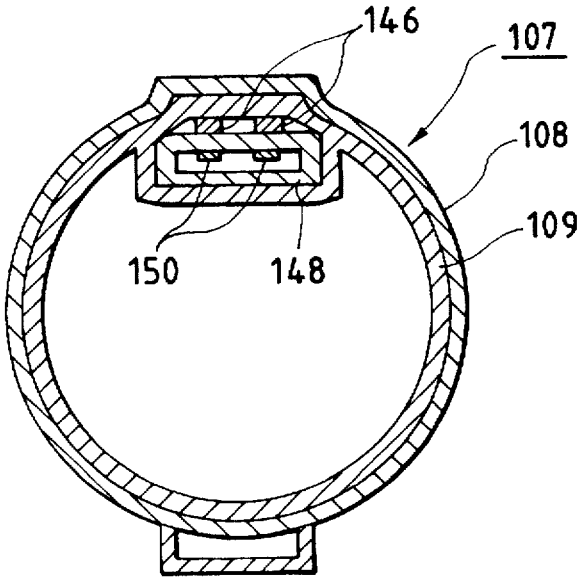
FIG. 44 is a sectional view of the extension pipe taken along the line O—O in FIG. 43.

FIGS. 43 and 44 show a fifteenth embodiment of this invention which is similar to the embodiment of FIGS. 1–6 except for design changes indicated hereinafter.

In the embodiment of FIGS. 43 and 44, an inner tube 109 is provided with an axially-extending conductor casing 145. The conductor casing 145 is integral with a main portion of the inner tube 109.

A pair of axially-extending electric conductors 146 are provided on the ceiling of the conductor casing 145. The electric conductors 146 lead from terminals 117. The electric conductors 146 are similar in shape to rails.

An outer tube 108 is provided with an axially-extending sub tube 148 which forms a conductor casing for accommodating a pair of axially-extending electric conductors 147. The sub tube 148 is disposed in an inner space defined by the cylindrical main walls of the outer tube 108. The sub tube 148 is integrally fixed to the walls of the outer tube 108. First ends of the electric conductors 147 are connected to terminals 116 provided on the outer tube 108. The connection between the electric conductors 147 and the terminals 116 are concealed by a cover 149 prodded on the outer tube 108. Second ends of the electric conductors 147 are connected to resilient contacts 150 respectively. The resilient contacts 150 are supported on the outer tube 108. The resilient contacts 150 are in touch with the electric conductors 146 respectively. The resilient contacts 150 can slide relative to the electric conductors 146.

The sub tube 148 in the outer tube 108 slidably extends into the conductor casing 145 in the inner tube 109. The cylindrical main walls of the outer tube 108 and the cylindrical walls of the conductor casing 145 define a space therebetween into which the outer walls of the conductor casing 139 in the inner tube 109 and also the electric conductors 146 slidably extend.

An adjustment mechanism 113 for adjusting the position of the inner tube 109 relative to the outer tube 108 is provided on a side of an extension pipe 107 opposite the conductor casing 145 and the sub tube 148.

As the inner tube 109 is moved relative to the outer tube 108 to expand and contract the extension pipe 107, the contacts 150 slide relative to the electric conductors 146 while remaining in touch therewith. Therefore, during the movement of the inner tube 109 relative to the outer tube 108, electric connection between the terminals 116 and 117 is continuously maintained.

The conductor casing 145 for accommodating the electric conductors 146 can be thin since the electric conductors 146 have a rail shape. This is advantageous in miniaturizing and lightening the extension pipe 107.

Sixteenth Embodiment

Figure 45:
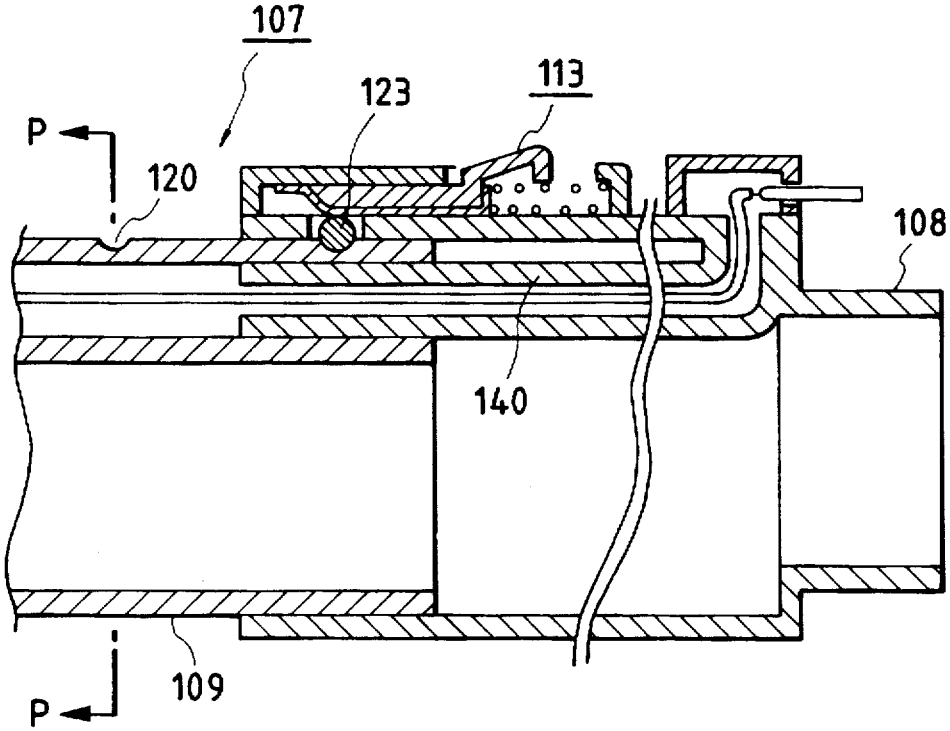
FIG. 45 is a sectional view of an extension pipe according to a sixteenth embodiment of this invention.
Figure 46:
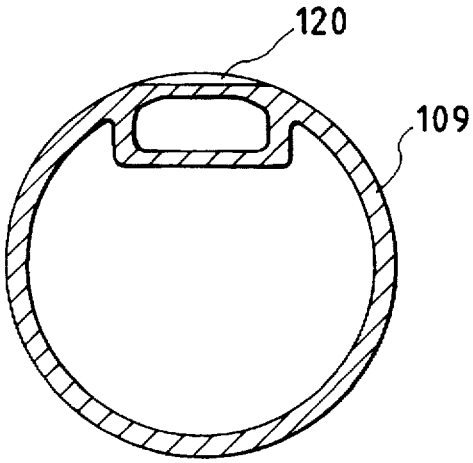
FIG. 46 is a sectional view of the extension pipe taken along the line P—P in FIG. 45.

FIGS. 45 and 46 show a sixteenth embodiment of this invention which is similar to the embodiment of FIGS. 31–33 except for design changes indicated hereinafter.

In the embodiment of FIGS. 45 and 46, an adjustment mechanism 113 for adjusting the position of an inner tube 109 relative to an outer tube 108 is provided on a side of an extension pipe 107 in which a sub tube 140 and a conductor casing 139 extend. The adjustment mechanism 113 has a major portion including an engagement member 123 and a pressing plate 124. The major portion of the adjustment mechanism 113 is provided on the outermost walls of the outer tube 108. Engagement recesses 120 are formed in outer surfaces of the conductor casing 139 in the inner tube 109.

The conductor casing 139 is integral with a main portion of the inner tube 109. The engagement recesses 120 are formed in the conductor casing 139. It is possible to firmly and reliably hold a part of the engagement 123 in any one of the engagement recesses 120 even when an axial force is applied to the inner tube 108.

What is claimed is:

1. An electric vacuum cleaner comprising:

a main body;

a hose connected to the main body;

a floor nozzle;

a motor-drive brush provided in the floor nozzle;

an extension pipe connecting the floor nozzle and one end of the hose; and an electric conductor located in the extension pipe;

wherein the extension pipe comprises an outer tube, an inner tube, a first electric connection terminal provided on one end of the outer tube, a second electric connection terminal provided on one end of the inner tube, the inner tube slidably extending into the outer tube, a flexible electric conductor connected between the first electric connection terminal and the second electric connection terminal, the flexible electric conductor being accommodated in a first conductor casing and a second conductor casing, the first conductor casing being provided on the exterior of the outer tube, the second conductor casing being provided on the exterior of the inner tube, the outer tube having a dust suction passage, the inner tube having a dust suction passage, the first conductor casing having an interior isolated from the dust suction passage in the outer tube, the second conductor casing having an interior isolated from the dust suction passage in the inner tube, said flexible conductor folding and unfolding to accommodate sliding of the inner tube within the outer tube.

2. The electric vacuum cleaner of claim 1, wherein the first conductor cashing is fixed to the outer tube and the second conductor casing is fixed to the inner tube, and the second conductor casing slidably extends into the first conductor casing.

3. The electric vacuum cleaner of claim 1, wherein the electric conductor folds at least at one position in an axial direction.

4. The electric vacuum cleaner of claim 1, further comprising means for allowing adjustment of a relative position between the inner tube and the outer tube, wherein the allowing means comprises a plurality of engagement portions provided in an outer surface of the inner tube and spaced in an axial direction, an engagement member provided on the outer tube and being engageable with any one of the engagement portions, and an operation member for controlling the engagement member.

5. The electric vacuum cleaner of claim 4, wherein the engagement portions and the engagement member are located at a side of the extension pipe opposite the first conductor casing and the second conductor casing.

6. The electric vacuum cleaner of claim 1, wherein the first conductor casing is integral with the outer tube and the second conductor casing is integral with the inner tube, and the second conductor casing slidably extends into the first conductor casing.

7. An electric vacuum cleaner comprising:

a main body;

a hose connected to the main body;

a floor nozzle;

a motor-drive brush provided in the floor nozzle; and an extension pipe connecting the floor nozzle and one end of the hose;

wherein the extension pipe comprises an outer tube, an inner tube, a first electric connection terminal, a second electric connection terminal, a flexible electric conductor, and a conductor casing located on the exterior of said inner tube, the first electric connection terminal being provided on one end of the outer tube, the second electric connection terminal being provided on one end of the inner tube, the inner tube slidably extending into the outer tube, the flexible electric conductor being connected between the first electric connection terminal and the second electric connection terminal, the electric conductor being partially accommodated in the conductor casing, the conductor casing being integrally and axially provided on the inner tube, said flexible electric conductor folding and unfolding to accommodate said inner tube sliding within said outer tube.

8. The electric vacuum cleaner of claim 7, further comprising a sub tube slidably extending into the conductor casing and provided on the outer tube, the sub tube accommodating a part of the flexible electric conductor.

9. The electric vacuum cleaner of claim 7, wherein at least part of the electric conductor comprises a flexible flat cable.

10. The electric vacuum cleaner of claim 7, wherein a part of the electric conductor comprises an expandible and contractible member.

11. The electric vacuum cleaner of claim 7, further comprising means for allowing adjustment of a relative position between the inner tube and the outer tube, wherein the allowing means comprises a plurality of engagement portions provided in an outer surface of the inner tube and spaced in an axial direction, an engagement member provided on the outer tube and being engageable with any one of the engagement portions, and an operation member for controlling the engagement member.

12. The electric vacuum cleaner of claim 11, wherein the engagement portions and the engagement member are located at a side of the extension pipe opposite the conductor casing.

* * * * *